US011946260B2

(12) United States Patent
Ylikangas et al.

(10) Patent No.: US 11,946,260 B2
(45) Date of Patent: Apr. 2, 2024

(54) SET FOR ASSEMBLING BUILDING ELEMENTS AND CONNECTING DEVICE THEREFORE

(71) Applicant: Välinge Innovation AB, Viken (SE)

(72) Inventors: Roger Ylikangas, Lerberget (SE); Karl Quist, Höganäs (SE)

(73) Assignee: Välinge Innovation AB, Viken (SE)

( * ) Notice: Subject to any disclaimer, the term of this patent is extended or adjusted under 35 U.S.C. 154(b) by 56 days.

(21) Appl. No.: 17/456,406

(22) Filed: Nov. 24, 2021

(65) Prior Publication Data

US 2022/0170275 A1 Jun. 2, 2022

(30) Foreign Application Priority Data

Nov. 27, 2020 (SE) ..... 2051383-4

(51) Int. Cl.
*E04F 13/08* (2006.01)

(52) U.S. Cl.
CPC ..... *E04F 13/0826* (2013.01); *E04F 13/0894* (2013.01); *E04F 2201/0153* (2013.01); *E04F 2201/023* (2013.01)

(58) Field of Classification Search
CPC ..... E04F 13/0826; E04F 13/0894; E04F 13/0821; E04F 13/26; E04F 2201/0153; E04F 2201/023
See application file for complete search history.

(56) References Cited

U.S. PATENT DOCUMENTS 6,315,489 B1 * 11/2001 Watanabe ..... E04F 13/0846 248/220.21
6,609,342 B2 * 8/2003 Hikai ..... E04F 13/0864 52/506.01
9,850,667 B2 * 12/2017 Engstrom ..... E04F 15/02044
2002/0095889 A1 * 7/2002 Hikai ..... E04F 13/0889 52/235
2006/0032173 A1 * 2/2006 Hikai ..... E04F 13/0826 52/506.05
2008/0053024 A1 * 3/2008 Ito ..... E04F 13/007 52/718.01
2008/0216444 A1 * 9/2008 Loyd ..... E04F 13/0826 52/742.16

(Continued)

*Primary Examiner* — Gisele D Ford
(74) *Attorney, Agent, or Firm* — Boone IP Law

(57) ABSTRACT

A connecting device for connecting a first building element and first building panel, the connecting device including at least one primary connecting means extending in a direction along a primary axis and configured to cooperate with a first mechanical locking system of a first edge of the first building element, to obtain an assembled position therewith, preferably by means of a folding displacement of the connecting device about the primary axis, to thereby lock the connecting device from displacement along a secondary axis and a perpendicular tertiary axis each being orthogonal the primary axis. The connecting device includes secondary connecting means extending in a direction along the tertiary axis and configured to cooperate with a second mechanical locking system of respective first and opposite second edges of the first and preferably second building panel, wherein the connecting device further includes tertiary means for cooperating with the first panel.

16 Claims, 14 Drawing Sheets

(56) References Cited

U.S. PATENT DOCUMENTS

| | | | | |
|---|---|---|---|---|
| 2008/0296451 | A1* | 12/2008 | Yoshida | E04F 13/0808 248/220.1 |
| 2009/0084052 | A1* | 4/2009 | Ito | E04F 13/0889 52/270 |
| 2017/0058534 | A1* | 3/2017 | Engström | E04B 9/0435 |
| 2019/0055974 | A1* | 2/2019 | Vandenberg | E04F 15/10 |
| 2020/0018076 | A1* | 1/2020 | Fahle | E04F 13/0826 |
| 2020/0071934 | A1* | 3/2020 | Ochi | E04B 2/56 |
| 2020/0080317 | A1* | 3/2020 | Girnghuber | E04F 13/0819 |
| 2020/0087921 | A1* | 3/2020 | Sawada | E04F 13/0803 |
| 2020/0087922 | A1* | 3/2020 | Kotiadis | E04F 13/0825 |
| 2020/0308824 | A1* | 10/2020 | Ylikangas | E04B 1/185 |
| 2020/0340252 | A1* | 10/2020 | Carlson | E04B 5/02 |
| 2021/0148119 | A1* | 5/2021 | Evans | E04F 13/26 |
| 2021/0277667 | A1* | 9/2021 | Toluk | E04G 17/14 |

* cited by examiner

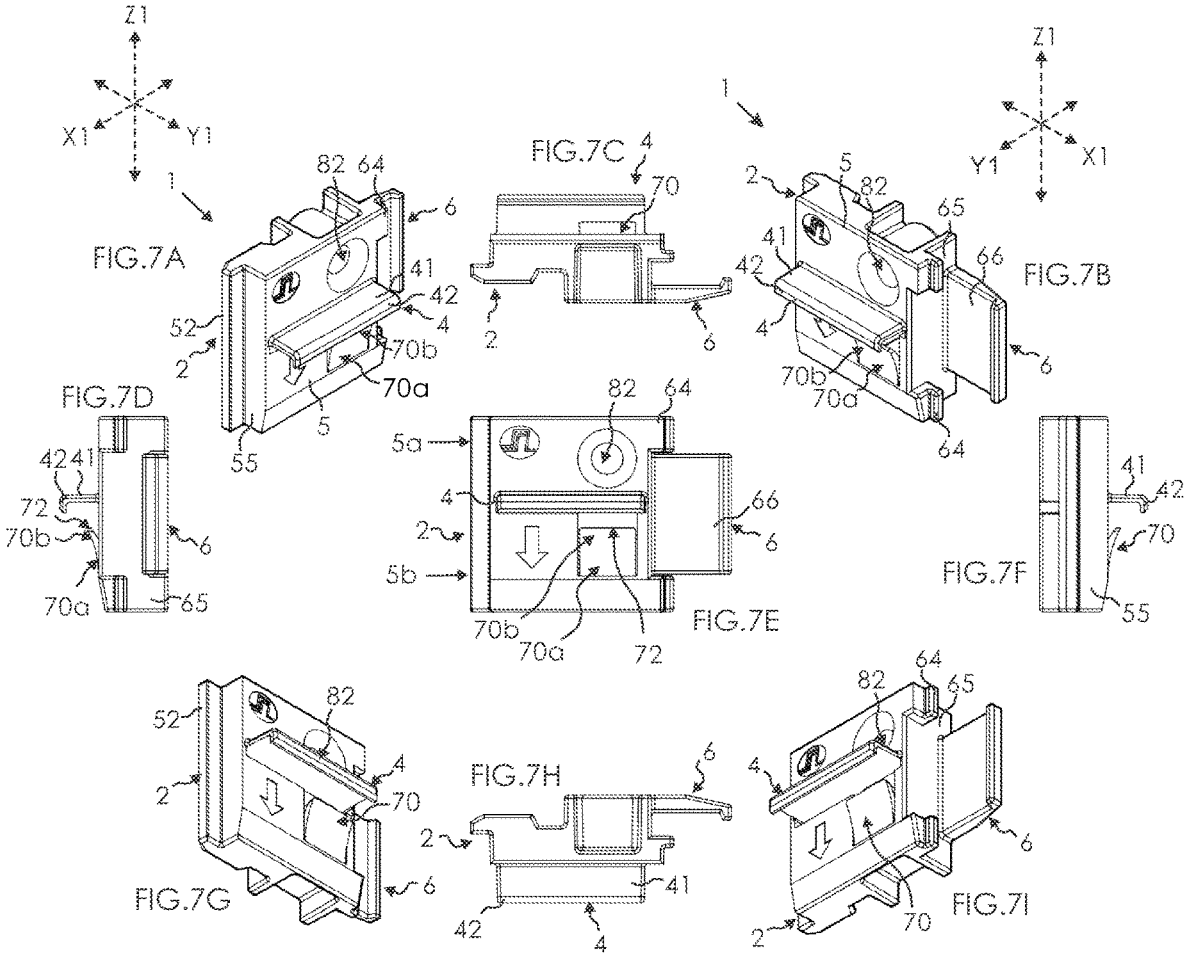
FIG.7A
FIG.7B
FIG.7C
FIG.7D
FIG.7E
FIG.7F
FIG.7G
FIG.7H
FIG.7I
Z1
X1
Y1
1
2
4
5
5a
5b
6
41
42
52
55
64
65
66
70
70a
70b
72
82
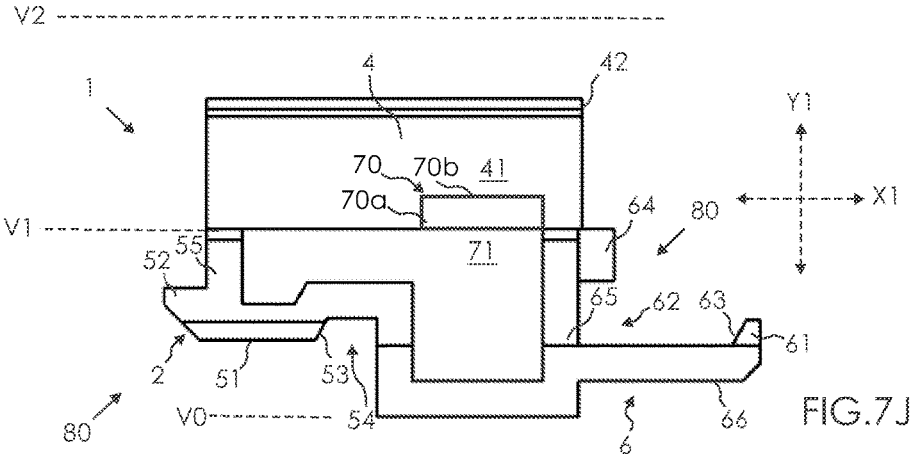
FIG.7J
V0
V1
V2
1
2
4
42
51
52
53
54
55
61
62
63
64
65
66
70
70a
70b
71
80
6
X1
Y1

Z1
X1
Y1
1
82
64
6
41
42
4
52
2
5
55
70b
70a

1
Z1
Y1
X1
82
2
65
41
42
66
4
70a
70b
5
6
65

4
70
2
6

64
42
4
6
70b
77
70b 82
64
66
5a
2
71
4
6
77
5b
70

55
41
4
42
77
2
70

55
82
52
4
2
6
70

6
2
41
42
4

82
65
4
6
70
2

Z1
X1
Y1
1
2
4
5
5a
5b
6
41
42
52
55
64
65
66
70
70a
70b
71
73
82

Z1
X1
Y1
1
2
4
5
5a
5b
6
41
42
52
55
64
65
66
70
76
82
20'
20
26
V1
V2
V3
P

SET FOR ASSEMBLING BUILDING ELEMENTS AND CONNECTING DEVICE THEREFORE

CROSS REFERENCE TO RELATED APPLICATIONS

The present application claims the benefit of Swedish Application No. 2051383-4, filed on Nov. 27, 2020. The entire contents of Swedish Application No. 2051383-4 are hereby incorporated herein by reference in their entirety.

TECHNICAL FIELD

Embodiments of the present inventive concept pertain to a connecting device for assembling building panels to a building element and a set comprising the connecting device.

BACKGROUND

Known systems for assembling building panels typically comprise various types fastening rails mounted to a fixed structure, such as a wall or like. Wall panels to be assembled are typically arranged to extend transverse the rails. A mounting device or like is fixedly attached to the rail or to the wall panel and provides a link between the rails and the wall panel.

Known systems are however associated with shortcomings in terms of flexibility of the system and/or compatibility of the system with different panels. As such, there is room for improvements in the technical field.

SUMMARY

It is an object of certain embodiments of the present inventive concept to provide improvements over the above described techniques and known art.

It is a further object of certain embodiments of the present inventive concept to facilitate advantageous positioning of a connecting device.

It is a further object of certain embodiments of the present inventive concept to prevent dislodging of a connecting device.

It is further objected of certain embodiments of the present inventive concept to provide a connecting device which facilitates accommodation of panels of different dimensions or thicknesses.

In the following text, the surface facing towards the user in assembled position and typically intended to be a visible surface of the installed building panel is called "front surface", while the opposite side of the building panel facing the subfloor, wall or like is called "back surface".

At least some of these objects and other objects and advantages that will be apparent from the description have been achieved by embodiments of the present inventive concept.

In a first aspect, there is provided a connecting device for connecting a first building element and first building panel, the connecting device comprising at least one primary connecting means extending in a direction along a primary axis and configured to cooperate with a first mechanical locking system of a first edge of the first building element, to obtain an assembled position therewith, preferably by means of a folding displacement of the connecting device about the primary axis, to thereby lock the connecting device from displacement along a secondary axis and a perpendicular tertiary axis each being orthogonal the primary axis. The connecting device comprises secondary connecting means extending in a direction along the tertiary axis and configured to cooperate with a second mechanical locking system of respective first and opposite second edges of the first and preferably second building panel.

In one embodiment, the secondary connecting means is configured to cooperate with a second mechanical locking system of the first edge of the first building panel and a second opposite edge of the second building panel, wherein said first and second edge are configured to cooperate for horizontal and vertical locking from parting away from each other by means of the second mechanical locking system.

The connecting device may further comprise tertiary means configured to cooperate with the first panel.

In one embodiment, the second locking system is configured for locking the first and second panels in a direction transverse of the plane of the front surface by means of a folding displacement of the second panel about its second edge.

The second locking system may be configured for locking the first and second panels in a direction along the primary axis, preferably by means of a folding displacement, such as a folding displacement of the second panel about its second edge.

In one embodiment, the second locking system of said second edge comprises a locking groove which opens in a direction along the tertiary axis in assembled position of the first and second panels, said locking groove configured to receive a locking element of the second locking system of the first edge of the first panel, said locking element extending in a direction along the tertiary axis.

The locking element may be received in said locking groove by means of said folding displacement of the second panel about its second edge of thereby lock the second panel and the first panel from parting away in a direction of the plane of the front surface and transverse the second edge of the first panel.

In one embodiment, the tertiary means comprises at least one protruding member.

The at least one protruding member may be configured to, in assembled position of the connecting device and the first building element, protrude from a primary plane of a proximal surface of the connecting device.

In one embodiment, the tertiary means are configured to, in assembled position, cooperate with a back surface of the first panel.

The tertiary means may be configured for relative positioning of at least a portion of the connecting device, such as the secondary connecting means, and at least a portion of the first panel, such as the first edge.

In one embodiment, the tertiary means are configured to, in assembled position of the connecting device with the first panel, bias against the back surface of the first building panel.

The tertiary means may be configured to, in assembled position of the connecting device with the first panel, bias the secondary connecting means in a direction along the tertiary axis towards the first building panel, such as in a distal direction.

In one embodiment, the tertiary means are configured to, during assembling of the connecting device with the first building panel, displace at least a portion of the first building panel and/or displace the connecting device in a direction along the tertiary axis.

The tertiary means may be configured to, in assembled position of the connecting device with the first panel, cooperate with a groove provided in the back surface of the first panel to thereby lock or prevent the secondary connecting means and the first edge of the first panel from parting away from each other in a direction along the primary axis.

In one embodiment, the tertiary means comprises at least one portion that is displaceable relative the secondary connecting means, such as in a direction along the tertiary axis.

The tertiary means may comprise an attached portion and at least one free portion, preferably said at least one free portion is an end portion.

In one embodiment, the tertiary means comprises at least one portion extending along the primary axis in a direction towards or away from secondary connecting means, and from an attached portion to a free portion.

The at least one portion of said tertiary means, preferably the second portion, may comprise a continuous edge or a discontinuous edge in a direction along the secondary axis.

In one embodiment, the at least one portion of said tertiary means, preferably the second portion, comprises means configured to facilitate friction, such as friction between said at least one portion and an adjacent surface, such as the back surface of the first panel.

The means configured to facilitate friction may comprise sharp and/or pointy elements.

In one embodiment, the tertiary means comprises a material being different from a material of a body of the connecting device, preferably said material configured to facilitate a frictional force being relatively greater than said material of the connecting device body in response to a provided pressure or force.

The tertiary means may comprise a round or semi-spherical shape.

In one embodiment, the tertiary means comprises an essentially cylindrical shape, preferably having a longitudinal axis parallel secondary axis.

The tertiary means may comprise a curved profile between the first portion and the second portion, wherein the curved profile comprises a concave shape which recesses inwards towards the connecting device body or a convex shape which recesses outwards away from the connecting device body.

In one embodiment, the connecting device body comprises a slot, wherein said tertiary means is provided at least partially in said slot.

The slot may be configured to at least partially receive said tertiary means, such as a displaceable second portion thereof.

In one embodiment, at least a portion of the tertiary means is integrally formed with the connecting device.

In a second aspect there is provided a set comprising the connecting device, a building element and a building panel according to any one of the preceding embodiments.

In one embodiment, the first locking system and the second locking system are essentially identical or identical locking systems.

BRIEF DESCRIPTION OF DRAWINGS

Embodiments of the present inventive concept will by way of example be described in more detail with reference to the appended schematic drawings, which show several embodiments of the inventive concept.

FIGS. 7A-7I show isometric views of the connecting device of FIG. 6B.

FIG. 7J is a schematic side view of a connecting device according to an embodiment.

FIGS. 8A-8I show isometric views of a connecting device according to an embodiment.

DETAILED DESCRIPTION

Figure 1:
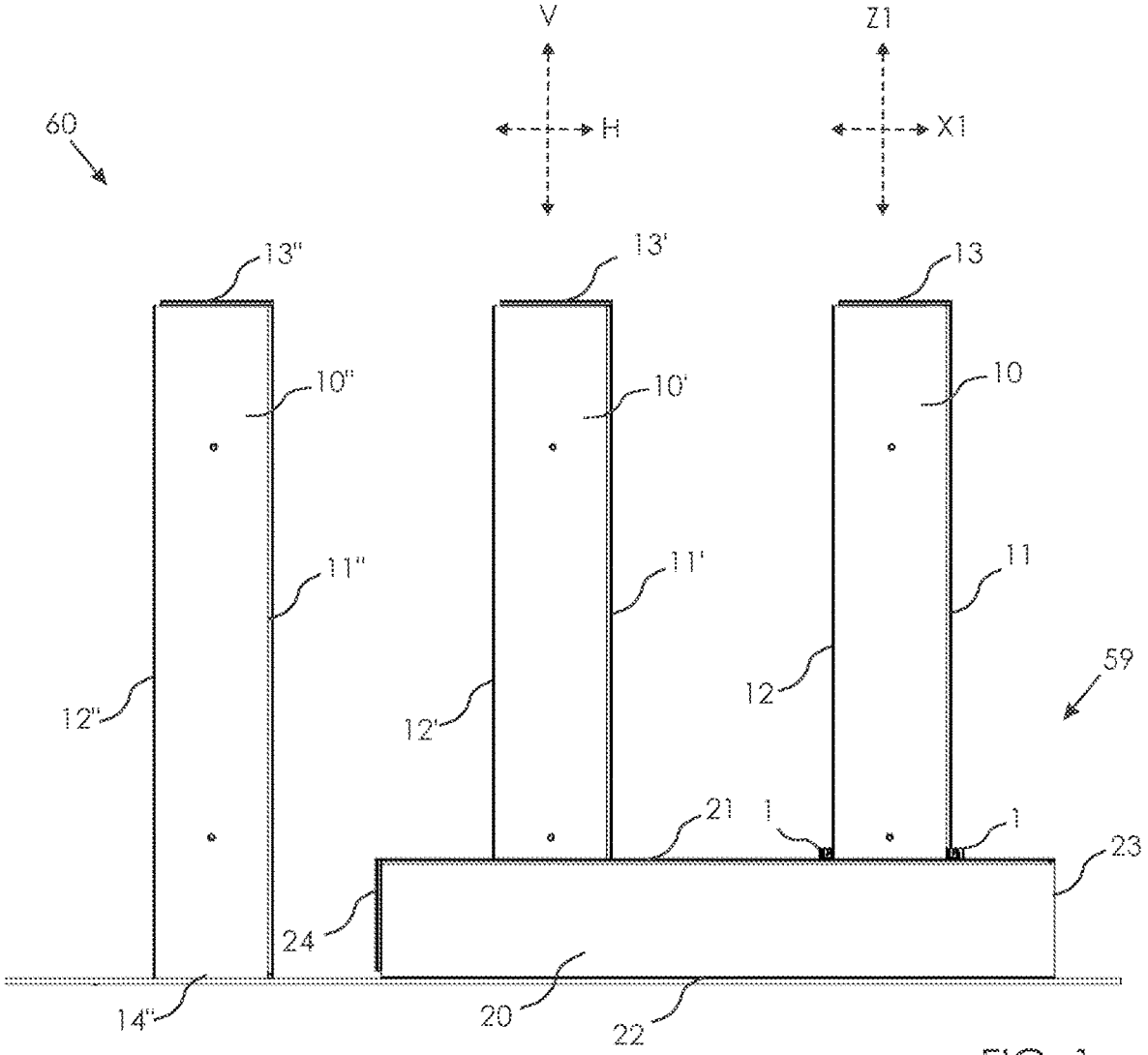
FIG. 1 is a schematic view of a set according to embodiments of the inventive concept.

FIGS. 1, 3 and 4A-4B show embodiments of a connecting device 1 and a set 60, which may be provided in shape of a system, comprising one or more building elements 10, 10' 10", which may be provided in shape of building panels, one or more building panels 20, 20' which may be provided in shape of wall panels, and one or more connecting devices 1, 1'.

The first building element 10 may, at least along a portion of an edge, comprise a first mechanical locking system 80 for horizontal and vertical locking of adjacent building elements comprising the first locking system 80. The building panels 20, 20' may at least along a portion of an edge comprise a second mechanical locking system 80' for horizontal and vertical locking of adjacent building elements comprising the second locking system 80', as shown in 5C.

The first mechanical locking system 80 and the second mechanical locking system 80' may be configured to cooperate such that a first building element 10 comprising the first locking system 80 can be configured in an assembled position with a second building element 20' comprising the second locking system 80', to thereby lock first and second elements 10, 20 in a horizontal and a vertical direction.

Thus, the first building element 10 and the first building panel 20 may according to embodiments comprise the same mechanical locking system.

The first building element 10 and the first building panel 20 may according to embodiments comprise essentially identical or similar panels.

Figure 3:
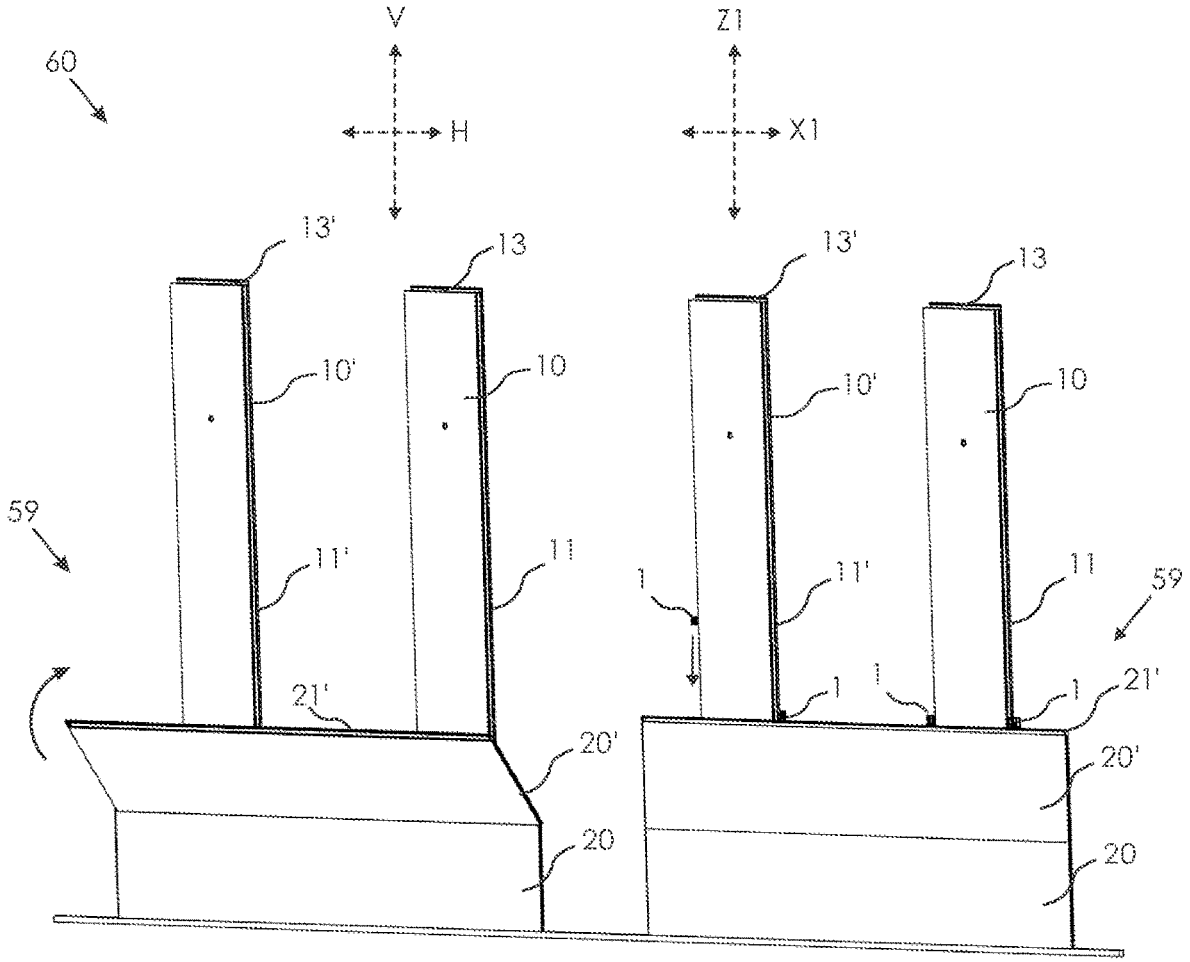
FIG. 3 is a perspective view of a set according to an embodiment.

In FIGS. 1 and 3, the set 60 is arranged as a wall 59 with the building panels 20, 20' arranged with their respective longitudinal axis extending horizontally H, however other configurations are possible within the scope of the disclosure.

Referring to FIGS. 1, 3, 4A-4B, the first edge 21 of the first panel 20 may constitute an upper edge of the first panel 20 in assembled position of the first panel 20, as illustrated in FIG. 1.

The second edge 22 of the first panel 20 may constitute a lower edge of the first panel 20 in assembled position of the first panel 20.

The first edge 11 of the first building element 10 may constitute a right-hand edge of the first building element 10 in assembled position of the first building element 10 as illustrated e.g. in FIGS. 1, 3 and 4. However, other configurations are possible within the scope of the disclosure, such as a left-hand edge.

The second edge 12 of the first building element 10 may constitute a left-hand edge of the first building element 10 in assembled position of the first building element 10 as illustrated in FIGS. 1, 3 and 4A-4B. However, other configurations are possible within the scope of the disclosure, such as a right-hand edge.

As mentioned, the panels, such as the first building element 10 and the first panels 20 may have a respective front surface 15, 25 and back surface 16, 26. The front surface 15, 25 may be a proximal and/or front surface. The front surface may be a surface intended to be visible when the panel is configured as part of a wall or floor. The front surface may be a decorative surface and may comprise a decorative layer, such as a veneer layer intended to be visible.

The back surface 16, 26 may be a surface which is not intended to be visible when the panel is configured as part of a wall or floor. The back surface may comprise a balancing layer to account for movements in the front surface 15, 25.

The building panels 20, 20', and optionally the building elements 10, 10', may comprise a core made of or comprising any suitable material, such as wood, MDF, HDF, foam, wood, polymers, thermoplastic, thermosetting, PVC, MgO, or any suitable material. Preferably, the core is made of a material suitable for machining, such as cutting, for example by means of rotating tools. The first and/or second mechanical locking system 80, 80' may be formed in the core of the building element, for example by means of cutting with rotating tools which are substantially stationary while the building elements are conveyed past the rotating tool to thereby form at least part of the mechanical locking system in one or more of the edges 11, 12, 21, 22 of the building elements.

The building elements of the set 60, such as the first building element 10 and/or the first panel 20, may each have an extension in a longitudinal direction L, such as the longest side or long side, and in a transverse direction T, such as the shortest side or short side, as illustrated in FIG. 1. Further, the panels may each have thickness extension in the thickness direction D as illustrated in FIG. 4B.

The first mechanical locking system 80 of the first building element 10 and/or the second mechanical locking system 80' of the first panel 20 may comprise edges for locking of one or more similar panels, such as the first building panel 20 and a second panel 20', in the plane of the front surface 15, 25, 25' and/or the back surface 16, 26, 26' in order to keep the first and second panels 20, 20' from separating in a direction transverse the edges comprising the mechanical locking system 80, 80'.

In the exemplary embodiment of FIGS. 1, 3 and 4A-4B, a first edge 11 of the first building element 10 may constitute an edge extending in the longitudinal direction of the first building element 10, which may be parallel a primary axis Z1 in assembled position of the first building element.

A second edge 12 of the first building element 10 may constitute an edge opposite the first edge 11 and extending in the longitudinal direction of the first building element 10, which may be parallel a primary axis Z1 in assembled position of the first building element 10.

Figure 2A:
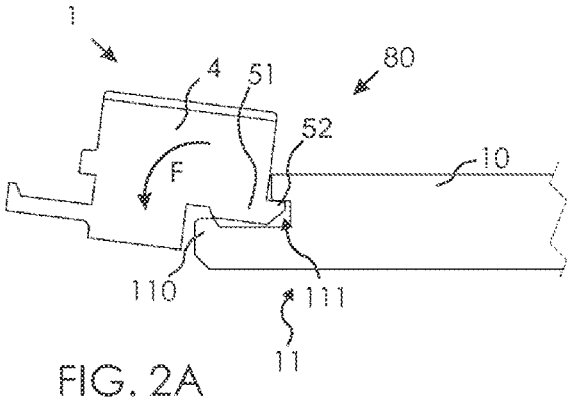
FIGS. 2A-2D are top view of details of the connecting device and building element of the embodiment of FIG. 1.
Figure 2B:
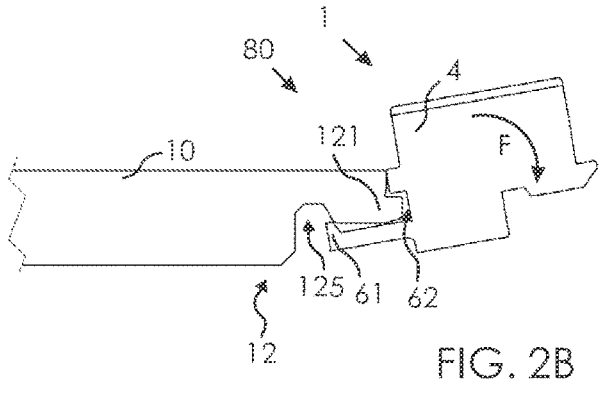

FIGS. 2A-2B show embodiments of the first building element 10 comprising the first mechanical locking system 80, and a connecting device 1 comprising the first locking system 80, wherein the connecting device 1 is configured in assembled position with the first building element 10 by means of a folding displacement F.

Figure 2C:
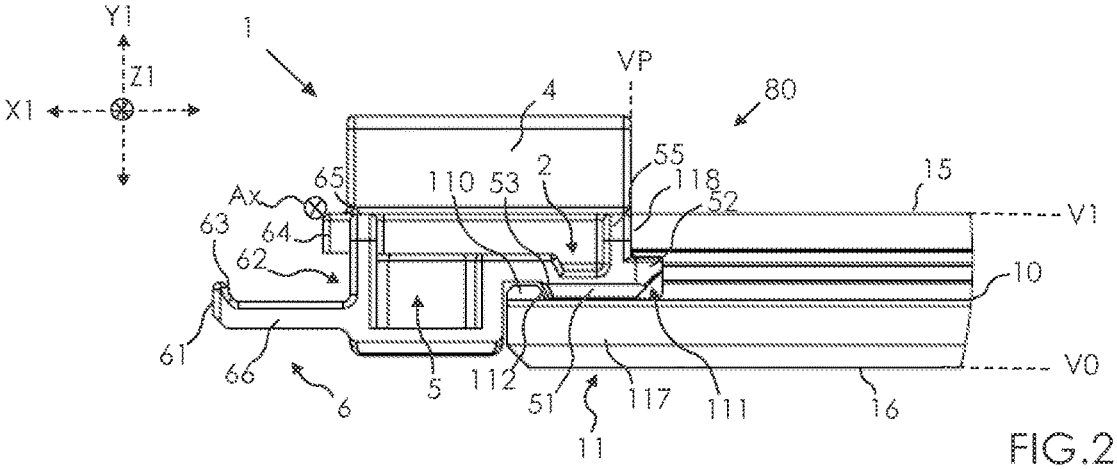
Figure 2D:
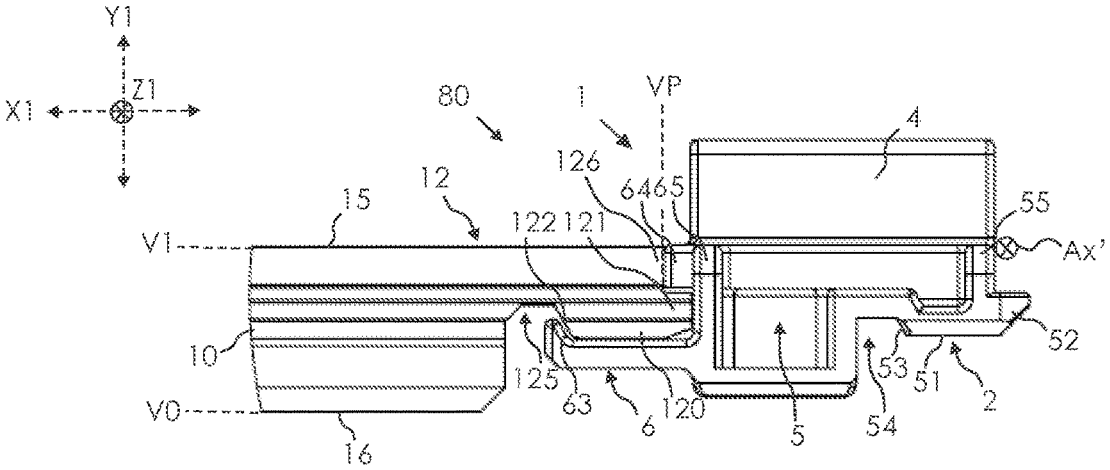

In assembled position of the connecting device 1 with the first building element 10, a front surface 15 of the first building element 10, such as a proximal and outwards facing surface, may be essentially flush with a primary plane V1 defined by a front side or proximal side of the connecting device 1 as shown in FIGS. 2C-2D.

Figure 6A:
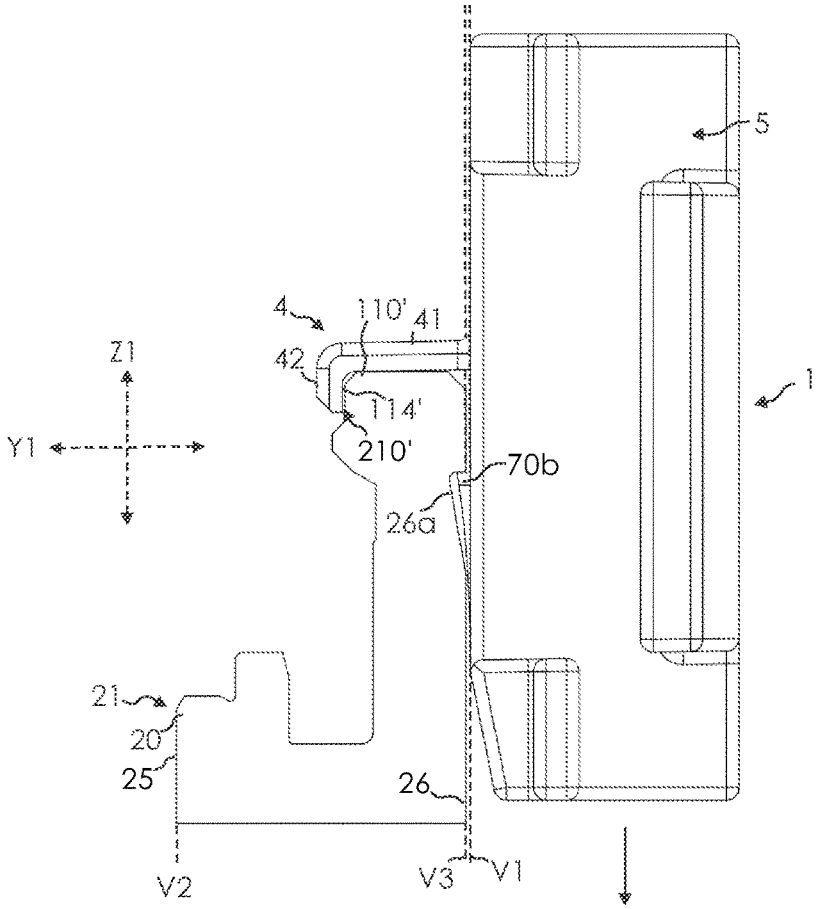
FIG. 6A shows a connecting device in assembled position with a first panel according to an embodiment.
Figure 6B:
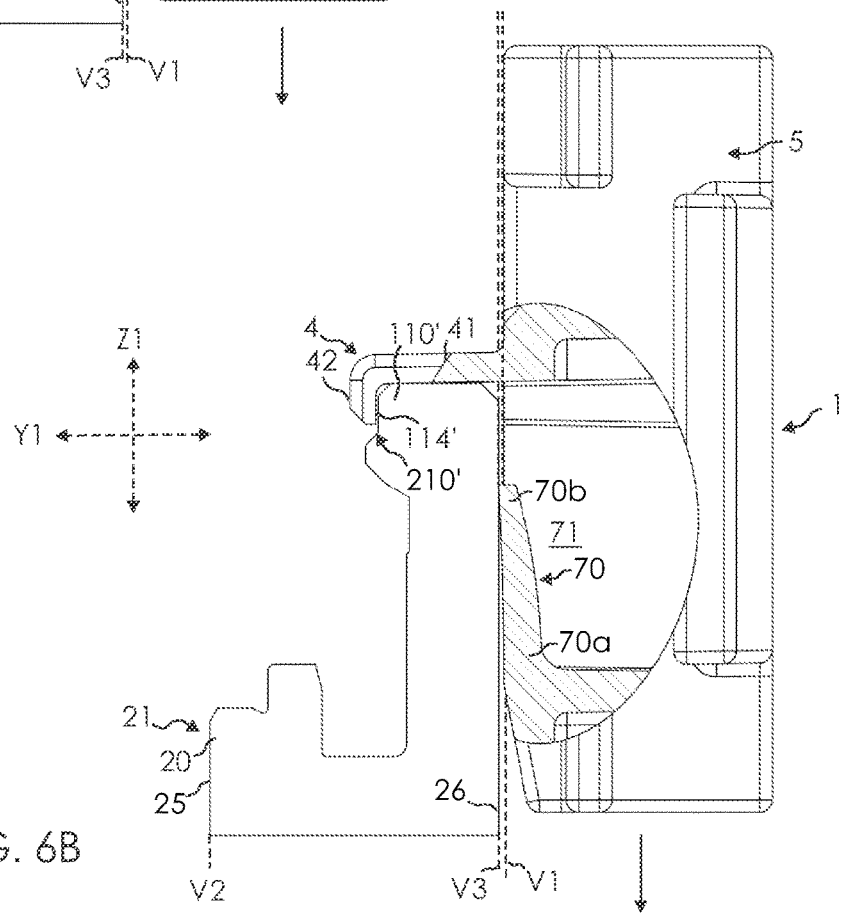
FIG. 6B shows a connecting device in assembled position with a first panel according to an embodiment.

In assembled position of the connecting device 1 with the first building panel 20, a front surface 25 of the first building panel 20, such as a proximal and outwards facing surface, may form a secondary plane V2 and a back surface 26 of the first panel 20 may form a tertiary plane V3 as shown in FIGS. 6A-6B.

Generally in this disclosure, the term "edge" refers to an outer edge extending in the thickness direction D of the building element or panel, such as the first building element 10 or the first building panel 20, between the front surface 15, 25 and the back surface 16, 26 of the respective building element. Thus, the edges may face in a direction along the secondary axis X1 and/or along the front surface 15 away from the building element 10, as shown in FIGS. 2A-2D.

The first building element 10 may be in the shape of a joist or like, having an outer edge facing in a direction along the front surface 15 and comprising a mechanical locking system 80 for horizontal and vertical locking with other building elements comprising the same locking system 80, preferably by means of folding.

Referring to FIGS. 2A-2D, primary connecting means 2, 6 may be configured to extend along a portion of the first edge 11 in assembled position of the first building element 10 and the connecting device 1.

The primary connecting means 2, 6 may be configured to engage with a portion of the first edge 11 extending along the primary axis Z1.

Two opposite edges of the connecting device 1 may comprise the first primary connecting means 2 and a second primary connecting means 6 respectively, as shown for example in FIGS. 2A-2D, and 7A-7J, 8A-8J, 9A-9I. 10A-10I, 11A-11J, 12A-12J, 13A-13I.

Referring in particular to FIGS. 2A-2D and 7J, the first primary connecting means 2 may comprise a first locking edge 55 configured to extend along the primary axis Z1 and the tertiary axis Y1. The first locking edge 55 may extend with a right-angle from a locking tongue 52, i.e. form an essentially right-angle with an adjacent upper tongue surface of the locking tongue 52. The first locking edge 55 may extend in a direction opposite a locking element 51 of the first primary connecting means 2.

The first locking edge 55 may be configured to abut a portion of the first edge 11 of the first building element 10 such as to prevent rotation of the connecting device 1 about an axis parallel the tertiary axis Y1 when in assembled position with the first building element 10. The first locking edge 55 and the edge portion of the first edge 11 may extend in parallel to form a plane parallel the plane of the primary axis Z1 and the tertiary axis Y1.

The first locking edge 55 may be configured to abut a portion of the first edge 11 of the first building element 10 such as to prevent displacement of the connecting device 1 in a direction along the secondary axis X1 towards the first building element 10, when the first building element 10 is configured in assembled position.

The first edge 11 of the first building element 10 may comprise a tongue groove 111 which opens in a direction parallel the front surface 15 of the first building element 10 which may be in a direction along the secondary axis X1 and transverse the first edge 11 and/or transverse the longitudinal extension of the first building element 10. The tongue groove 111 may be configured to receive the locking tongue 52 of the first primary connecting means 2 by means of a folding displacement of the connecting device 1 about the primary axis Z1, for locking the connecting device 1 and the first building element 10 in a direction along the tertiary axis Y1.

The locking element 51 may comprise the locking tongue 52 and a locking surface 53. In response to the folding displacement of the connecting device 1 about the primary axis Z1, the locking surface 53 is displaced to be positioned to cooperate with the locking surface 112 of the locking element 110 of the first edge of the first building element 10 for locking of the connecting device 1 and the first building element 10 in a direction along the secondary axis X1, in particular in a direction away from each other.

Shown in FIG. 2C is a first pair of locking surfaces; first locking surface 53 and second locking surface 112 configured to engage with each other for locking of the connecting device 1 in a direction along the secondary axis X1, when the connecting device 1 is engaged to the first edge 11 of the first building element 10 by means of the first primary connecting means 2.

A first locking surface 53 extending substantially in a direction along the tertiary axis Y1 is provided by the locking element 51 of the first primary connecting means 2.

A second locking surface 112 extending substantially in a direction along the tertiary axis Y1 when the first building element 10 is in assembled position, is provided by the locking element 110 of the first edge 11 of the first building element 10.

Referring to FIGS. 2B and 2D the second primary connecting means 6 comprises a tongue groove 62 which opens in a direction parallel the front surface 15 of the first building element 10 in assembled position of the connecting device, which may be in a direction along the secondary axis X1 and transverse the first edge 11 and/or transverse the longitudinal extension of the first building element 10. The tongue groove 62 is configured to receive a locking tongue 121 of the second edge 12 of the first building element 10 by means of a folding displacement of the connecting device 1 about the primary axis Z1, for locking the connecting device 1 and the first building element 10 from parting in a direction along the tertiary axis Y1.

A locking element 120 may comprise the locking tongue 121 on one side and a locking surface 122 on an opposite side of the locking element 120. In response to the folding displacement of the connecting device 1 about the primary axis Z1, the locking surface 63 of the locking strip 66 of the second coupling portion 6 is displaced to be positioned to cooperate with the locking surface 122 of the locking element 120 of the second edge of the first building element 10 for locking of the connecting device 1 and the first building element 10 in a direction along the secondary axis X1, in particular in a direction away from each other.

The tongue groove 62 of the second primary connecting means 6 may be formed by a second locking edge 65 disposed between a protrusion 64 and a locking strip 66. The protrusion 64 may facilitate locking the connecting device 1 in a position where a front surface of the body 5 is arranged substantially flush with the front surface 15 as illustrated in FIG. 2D. The locking strip 66 may assembled position extend from the second locking edge 65 in a direction along the secondary axis X1 and in a direction being opposite the direction in which the locking tongue 52 extends. The protrusion 64 and the locking strip 66 may extend from opposite sides, preferably opposite sides seen along the secondary axis Y1, of the second locking edge 65 and extend in a direction along the secondary axis X1. The locking element 61 of the second primary connecting means 6 may be provided at an outermost portion of the locking strip 66. The locking element 61 may extend from the locking strip 66 in a direction along the tertiary axis Y1 in assembled position.

The protrusion 64 and an edge portion 126 of the second edge 12 adjacent the front surface 15 may in assembled position form a second vertical plane VP2 being parallel the plane of the primary axis Z1 and the tertiary axis Y1.

The locking element 61 may comprise a locking surface 63 configured to cooperate with a locking surface 122 of the second edge 12 of the first building element 10 for locking the connecting device 1 and the first building element 10 from separating in a direction transverse the second edge 12, such as along the secondary axis X1 in assembled position.

The second locking edge 65 may extend along the primary axis Z1 and the tertiary axis Y1.

The second locking edge 65 may be configured to abut a portion of the second edge 12 of the first building element 10 such as to prevent rotation of the connecting device 1 about an axis parallel the tertiary axis Y1 when the first building element 10 is configured in assembled position.

The second locking edge 65 may be configured to abut a portion of the second edge 12 of the first building element 10 such as to prevent displacement of the connecting device 1 in a direction along the secondary axis X1 towards the first building element 10, when the first building element is configured in assembled position.

In assembled position, the locking edges 55, 65 of the connecting device 1, may extend in a direction along the tertiary axis Y1 and the first locking edge 55 may, for example, extend from the locking tongue 52 towards the primary plane v1 to be arranged at least flush with the back surface 26 of the first panel 20 and/or the primary plane V1, as shown for instance in FIG. 2D. Thereby, when the first panel 20 and/or a second panel 20' is arranged in abutment with at least one of the locking edges 55, 65, the first panel 20 and/or second panel 20' may be biased outwards away from the connecting device 1 in a direction along the tertiary axis Y1 by the locking edges 55, 65 and biased inwards towards the connecting device 1 by the secondary connecting means 4, in assembled position of the first panel 20 and optionally the second panel 20'. Thus, the locking edges 55, 65 and the secondary connecting means 4 may facilitate proper positioning of e.g. the first panel 20 in directions along the tertiary axis Y1.

The locking edge 55 and an edge portion 118 of the first edge 11 adjacent the front surface 15 may in assembled position form a first vertical plane VP1 being parallel the plane of the primary axis Z1 and the tertiary axis Y1.

Shown in FIG. 2D is a second pair of locking surfaces; third locking surface 63 and fourth locking surface 122 configured to engage with each other for locking of the connecting device 1 in a direction along the secondary axis X1 when the connecting device 1 is engaged to the second edge 12 of the first building element 10 by means of the second primary connecting means 6. The third locking surface 63 is provided on a locking element 61 extending in a direction transverse the locking element 120 of the second edge 12 of the first building element 10. The locking element 61 extends along the tertiary axis Y1 and is provided on a locking strip 66 extending in along the secondary axis X1. Thereby the locking strip 66 and the locking element 61 forms a groove which opens in a direction along the tertiary axis Y1 and is configured to receive the locking element 120 for locking the connecting device 1 and the first building element 10 in a direction along the secondary axis X1 and in directions away from each other.

The third locking surface 63 extending substantially in a direction along the tertiary axis Y1 is provided by the locking element 61 of the second primary connecting means 6.

The fourth locking surface 122 extending substantially in a direction along the tertiary axis Y1 when the first building element 10 is in assembled position, is provided by the locking element 120 of the second edge 12 of the first building element 10.

The locking element 61 of the second primary connecting means 6 may cooperate with the locking element 120 of the second edge 12 of first building element 10. As derivable from FIG. 2B, the locking elements 61 and 120 may extend in substantially opposite directions to facilitate locking along the secondary axis X1. Also, the locking elements 61 and 120 may extend in a direction along the tertiary axis Y1 in assembled position of the first building element 10.

The second primary connecting means 6 may be formed to at least partially envelope the locking element 120 of the second edge 12, as shown in FIG. 2A.

The locking elements 51, 61 and 110, 120 may be disposed between the front surface 15 and the back surface 16 in assembled position of the first building element 10, as shown in FIGS. 2A-2B.

The second edge 12 of the first building element 10 may comprise a locking tongue 121 configured to be received in a corresponding tongue groove 62 of the second primary connecting means 6 of the connecting device 1. The locking tongue 121 may be integrally formed with the locking element 120 of the second edge 22. Thanks to the locking tongue 121 and tongue groove 62 of the second primary connecting means 6 of the connecting device 1, displacement of the connecting device 1 in directions transverse the first primary plane V1 is prevented. Thus, displacement of the connecting device 1 along the tertiary axis Y1 is locked, such as along the normal of the front surface 15.

The locking element 61 of the second primary connecting means 6 of the connecting device 1 may be formed outboard the tongue groove 62 of the second primary connecting means 6.

The second primary connecting means 6 may be formed to at least partially envelope the locking element 120 of the second edge 12 of the first building element 10.

It may thereby be achieved that the connecting device 1 is locked from displacement along the secondary axis X1 and tertiary axis Y1 while being displaceable along the primary axis Z1. Typically, the first and second edges 11, 12 extend substantially along the entire, or along the entire longitudinal L length of the element 10.

Figure 4A:
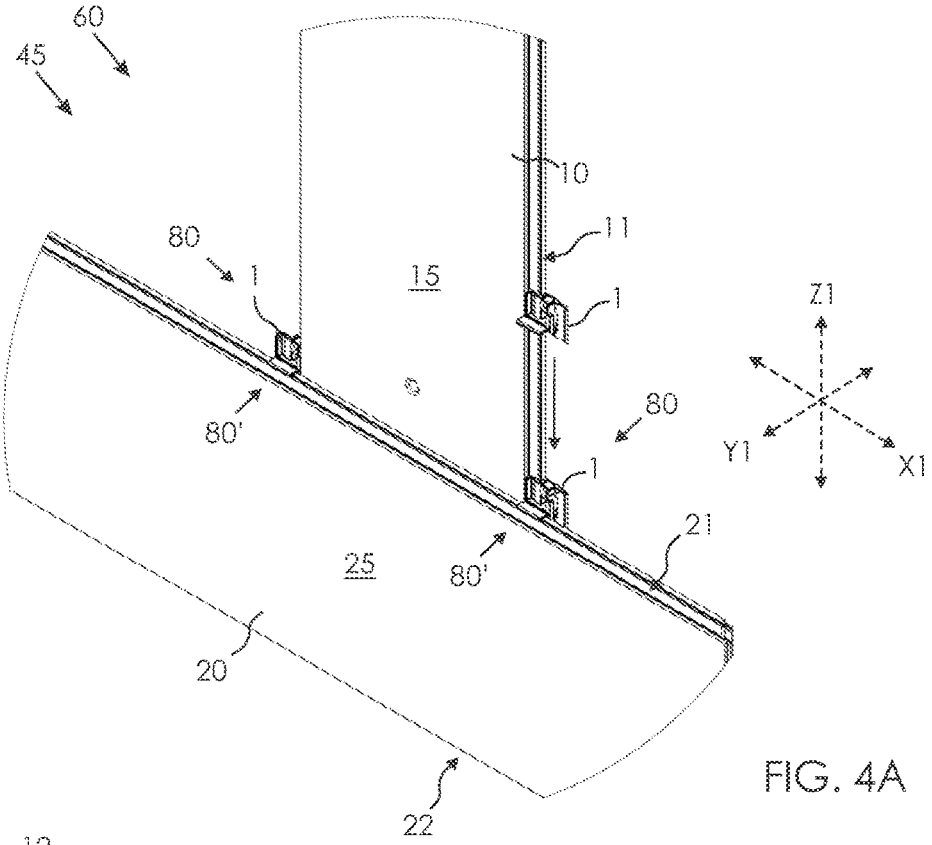
FIGS. 4A-4B are perspective views of details of the set of FIG. 3.
Figure 4B:
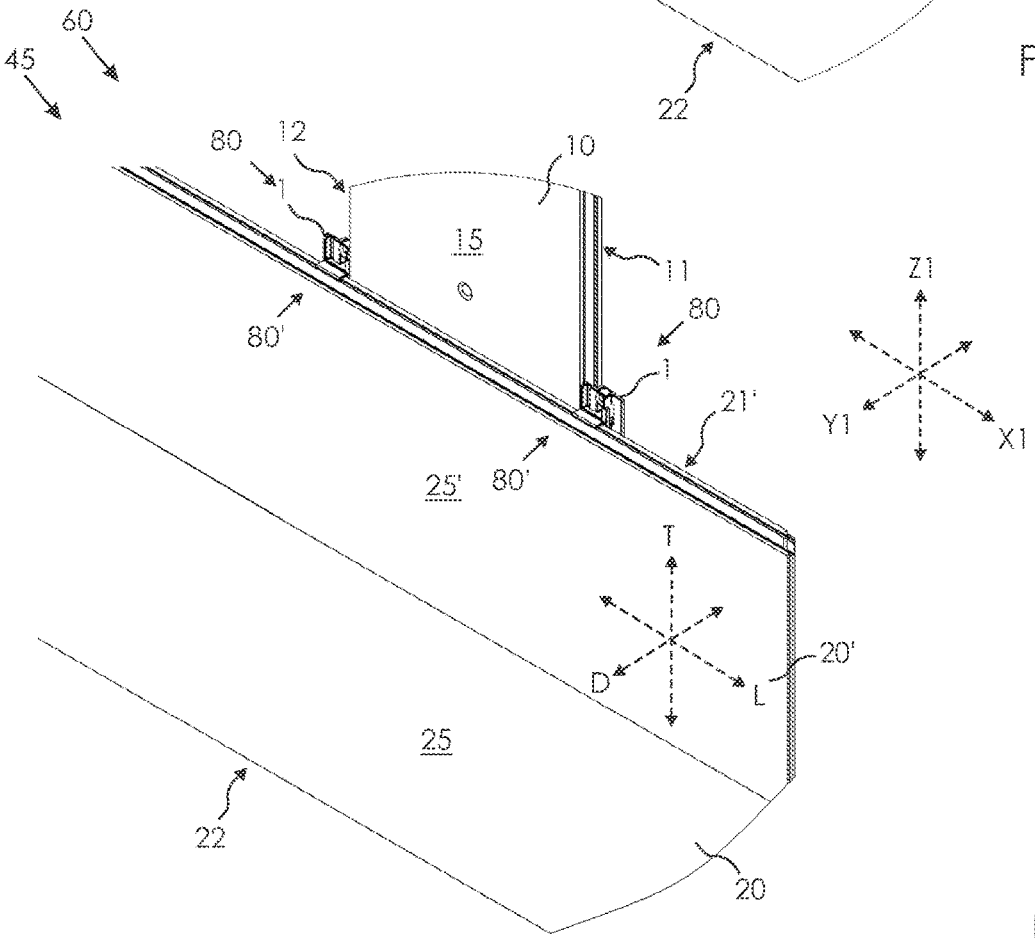

This configuration facilitates that the connecting device 1 may be configured in an assembled position with the first building element 10 some distance apart from the first panel 20, and then displaced along the primary axis Z1 to the extent that the secondary connecting means 4 engages with an edge, such as the first edge 21 of the first panel 20, to thereby obtain an assembled position with the first panel 20 and thus the first panel 20 is configured in assembled position with the connecting device, as shown in FIGS. 3 and 4A.

As explained above, the connecting device 1 may be arranged in an assembled position where it is coupled to the mechanical locking system 80 of a panel, such as the first building element 10.

Thanks to the connecting device 1 being displaceable in a direction parallel first and second edges 11, 12 of the first building element 10 in the assembled position, the connecting device 1 may alternatively be threaded on to the first or second edge 11, 12 at the short side of the first building element 10, i.e. at the third edge 13 or fourth edge 14.

Preferably, the connecting device 1 obtains the assembled position by a pivoting or folding displacement of the connecting device 1. In particular, the pivoting displacement may comprise pivoting about the primary axis Z1 for example when being parallel the first edge 11 and/or second edge 12 of the first building element 10 in assembled position, as shown in FIGS. 2A-2B. The pivot point of the pivoting or folding may be about an axis Ax, Ax' extending in a direction along the primary axis Z1. The respective axis Ax, Ax' may be positioned between the primary connecting means 2, 6 and the first edge 11 and/or the second edge 12 of the first building element 10 as schematically illustrated in FIGS. 2C-2D.

Figure 5A:
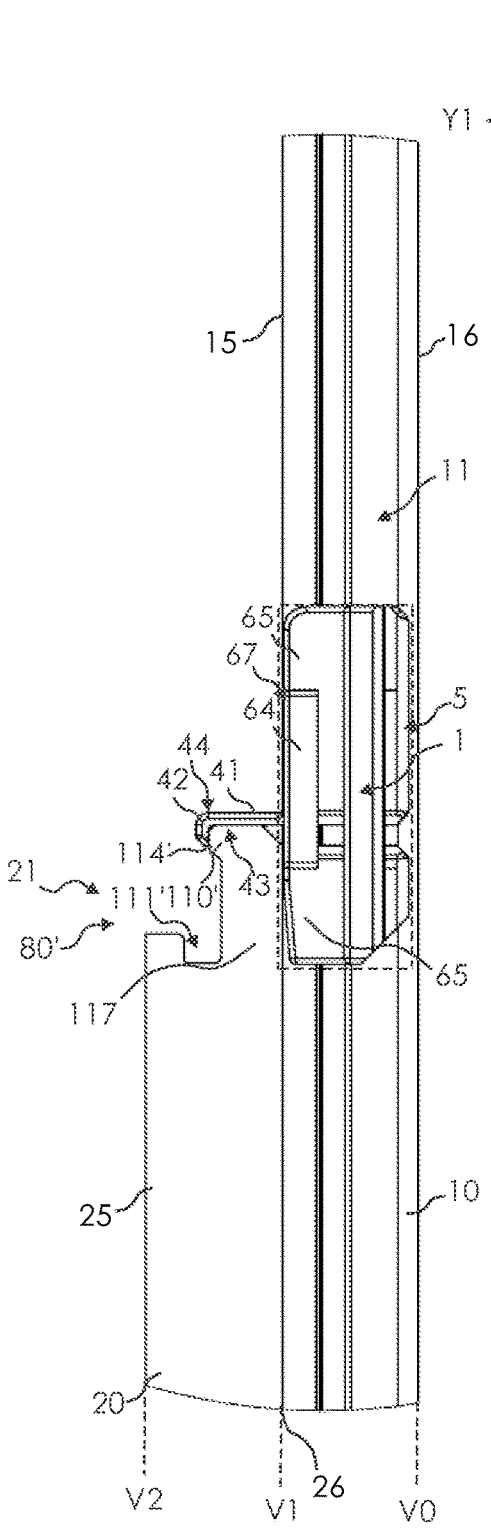
FIG. 5A is a side view of a first building panel arranged in assembled position with a first building element by means of a connecting device, according to an embodiment.
Figure 5B:
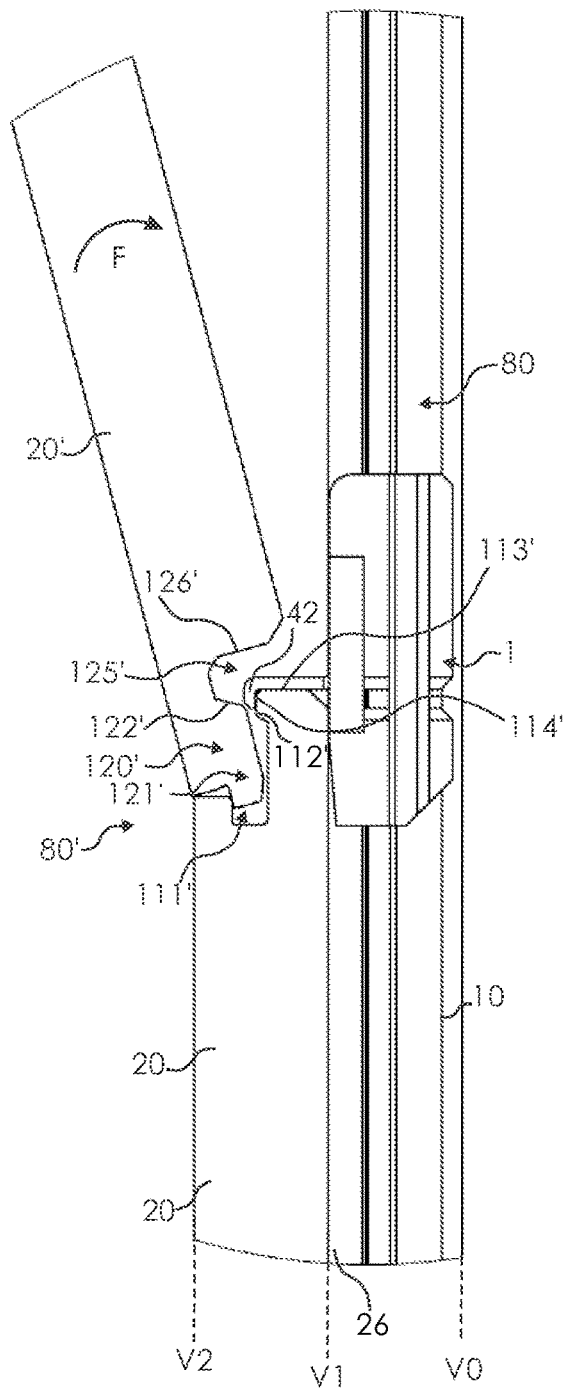
FIG. 5B is a side view of the embodiment of FIG. 5A with a second panel being assembled to the first panel by means of a folding displacement.

The secondary connecting means 4 may project from the body 5 towards the secondary plane V2, which may correspond to a direction along the tertiary axis Y1 as shown in FIGS. 2C-2D. The front surface 25 of the first building panel 20 may form the secondary plane V2 when the first building panel 20 arranged in assembled position with the first building element 10 and the connecting device 1, as shown in FIGS. 5A-5B.

The first building element 10 and the first panel 20 may be arranged with a relative angle between the respective longitudinal axis thereof, such as 90 degrees or transverse each other, as shown for example in FIGS. 1 and 3. The relative angle may however vary within the scope of the inventive concept.

Referring to FIGS. 5A-5C and FIGS. 6A-6B, the connecting device 1 may comprise the secondary connecting means 4 for engaging with a first edge 21 of a first panel 20 in assembled position. The secondary connecting means 4 may comprise a first portion 41 extending in a plane transverse the primary plane V1 towards the secondary plane V2 in assembled position of the first panel 20. The first portion 41 may extend in a direction along the tertiary axis Y1.

The first edge 21 of the first panel 20 may comprise the features as explained in relation to the first mechanical locking system 80 of the first edge 11 of the first building element 10. Also, the second edge 22 of the first panel 20 may comprise the features as explained in relation to the first mechanical locking system 80 of the second edge 12 of the first building element 10. Generally, the first edge 21 of the first panel 20 and the second edge 22' of the second panel 20' may be locked by the corresponding features and/or movements as described in relation to FIGS. 2A-2D; the first edge 21 of the first panel 20 may comprise features corresponding to the second primary connecting means 6 or the first edge 11 of the first building element 10; the second edge 22' of the second panel 20' may comprise features corresponding to the first primary connecting means 2 or the second edge 12 of the first building element 10.

The secondary connecting means 4 may comprise a groove 43 and/or a hook-shaped profile 44 configured to receive a portion of an edge of the first panel 20, such as the first edge 21 of the first panel 20. The second locking system 80' of the first edge 21 of the first panel 20 may be essentially identically shaped the first locking system 80 of the first as the edge 11 of the first building element 10. The hook-shaped profile 44 and/or the groove 43 may comprise the first portion 41 extending along the tertiary axis Y1 and a second portion 42 extending in a direction along the primary axis Z1.

The second portion 42 may thereby lock the first edge 21 of the first panel 20 from displacing in a direction along the tertiary axis Y1. The second portion 42 may engage with the locking element 110' of the first edge 21 of the first panel 20, which may correspond to the locking element 110 of the first edge 11 of the first building element 10.

For example in FIG. 5A it is shown that the second portion 42 may engage with the locking element 110' of the first edge 21 of the first panel 20, which may correspond to the locking element 110 of the first edge 11 of the first building element 10.

The first portion 41 may be configured to engage with an outermost edge surface 113' of the first panel 20 in assembled position of the connecting device 1 and the first panel 20, wherein said engaging may comprise extending along and being in abutment with the outermost edge surface 113' of the first panel 20. The outermost edge surface 113' may be disposed at a side of the locking element 110' being an opposite side of the locking surface 112'. Thereby, the tolerances of the cooperating locking surfaces 112' and 122' may not have to be adjusted to take account for the secondary connecting means cooperating with the second locking system 80'. Thereby, the need for a certain play between the locking surfaces 112' and 122' may not be necessary to account for the second portion, and thereby certain fitting of second locking system 80' maintained. Thus, the second locking system 80' of the first panel 20 and the second panel 20' may accommodate the secondary connecting means 4 without affecting the tolerances of the locking surfaces 112' and 122', thereby the first panel 20 and the second panel 20' may not slide away from each other in directions along the primary axis Z1 to cause a gap between the first edge 21 of the first panel 20 and the second edge 22' of the second panel 20'.

The cooperating locking surfaces 112' and 122' cooperate for locking of the first panel 20 and the second panel 20' in a direction along the primary axis Z1, to thereby lock the first edge 21 of the first panel 20 to the second edge 22' of the further second 20' in a vertical direction Z1 and away from each other when assembled as a wall.

The locking surface 122' may be provided in a locking groove 125' of the second panel 20', the locking groove 125' being configured to receive the locking element 110' of the first panel 20 to facilitate locking along the primary axis Z1 when the first edge 21 of the first panel 20 is assembled in locking position with the first edge 21' of the second panel 20'.

The second portion 42 may cooperate with an outermost edge surface 114', in a direction towards the front surface, of the locking element 110'.

Figure 5C:
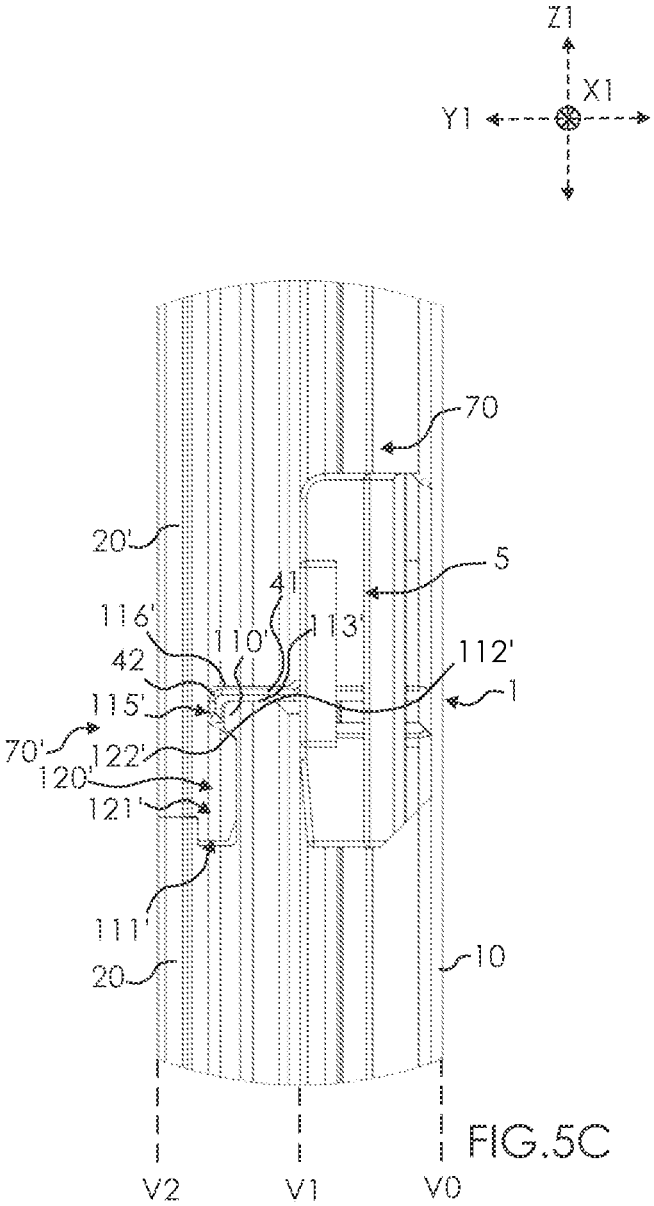
FIG. 5C is a side view of the embodiment of FIG. 5A with the second panel configured in assembled position with the connecting device and the first panel.

The first portion 41 may be interspaced and optionally clamped between a lower edge portion 126' of the second panel 20', which may be disposed inboard of locking tongue 121', and the outermost edge surface 113' of the first edge 21 of the first panel as shown in FIG. 5C.

The locking element 110' may be disposed between front surface 25 and back surface 26 of the first panel 20 in assembled position.

The locking element 110' may be integrally formed with a locking strip 117' forming a tongue groove 111' and/or extending from the tongue groove 111'.

The second portion 42 may preferably be received in a locking groove 125' of the second panel 20'. The locking groove 125' may be configured to receive said locking element 110' for mechanical locking of the first panel 20 and the second panel 20' in a direction of the plane of the front surface 25, and in a direction away from each other along the primary axis Z1.

The locking element 110' may comprise a locking surface 112' configured to cooperate with a locking surface 122' of the second panel 20' for locking of the first panel 20 and the second panel 20' in a plane, and in a direction transverse the first edge 21 and away from each other.

The locking element 110' may extend from locking strip 117' and along tertiary axis Y1 in assembled position.

A fourth locking surface 122' extending substantially in a direction along the tertiary axis Y1 when the first panel 20 in assembled position, is provided by the locking element 120' of the first edge 21 of the second panel 20'.

As illustrated in FIG. 5B, the locking groove 125' opens in a direction towards the plane of back surface 26' of the second panel 20' and is configured to receive the locking element 110' by means of a folding displacement F about the secondary axis X1 of the second panel 20' as shown in FIG. 5B and FIG. 3. Also, as shown in FIG. 5B, the locking groove 125' may be configured to receive at least the second portion 42 of the secondary connecting means, and optionally a portion of the first portion 41, by means of a folding displacement F about the secondary axis X1 of the second panel 20'.

Thereby, in assembled position of the first panel 20 and the second panel 20' to each other, wherein the first panel 20 and the second panel 20' are locked to each other by means of the second mechanical locking system 80', i.e., via direct engagement with each other, the second coupling portion 4 may simultaneously be locked to the first and second panel 20, 20' by means of engaging with the locking system 80'. Thereby, the connecting device 1 is locked from displacing at least in a direction along the primary axis Z1, such as vertically V upwards and downwards, and the tertiary axis Y, such as a front and back movement, and optionally also along the secondary axis X1 by means of the clamping of the second coupling portion 4 between the first edge 21 and the second edge 22'.

In assembled position, the locking groove 125' may open in a direction along the tertiary axis Y1 as shown in FIG. 5C towards the connecting device 1.

The tongue groove 111', as previously described, opens in a direction along the primary axis Z1, such as vertically V upwards. The tongue groove 111' may be configured to receive the locking tongue 121' of the second edge 22' of the second panel 20' by means of the folding F about the secondary axis X1 (see FIG. 5B and FIG. 3) to thereby lock the first panel 20 and the second panel 20' in a direction along the tertiary axis Y1, such as in a front direction and a back direction.

Thereby, the first panel 20 and the second panel 20' are locked horizontally and vertically by means of direct engagement between the first edge 21 of the first panel 20 and the second edge 22' of the second panel 20'.

FIGS. 6A-6B illustrate a locking element 110' of the first edge 21 of the first panel 20 provided with a shelf 210'. The shelf 210' may preferably be provided in a portion of the locking element 110' adjacent the secondary connecting means 4 which extends with its first portion 41 and optionally the second portion 42 optionally jammed between the first edge 21 of the first panel 20 and a second edge 22' of a second panel 20'. The shelf 210' may thus provide a void for accommodating the second portion 42 of the secondary connecting means 4. This configuration brings about the technical advantage that the extension of the locking element 110' of the first panel 20, such as in a direction of the tertiary axis Y1, may not have to be reduced to accommodate the secondary connecting means 4, and thus provides an improved more secure locking function. As derivable from FIGS. 6A-6B, in this embodiment the shelf 210' may comprise an outer edge surface 114' of the locking element 110', in a direction towards the front surface, which the second portion 42 may cooperate with.

The second portion 42 may cooperate with an outermost edge surface 114', in a direction towards the front surface, of the locking element 110'.

The second portion 42 may cooperate with an outermost edge surface 114', in a direction towards the front surface, of the locking element 110'.

The embodiment of FIGS. 6A-6B may be combined with any embodiment of the connecting device.

The embodiment of FIGS. 6A-6B may be combined with any embodiment of the connecting device.

In some embodiments, the first building element 10 and the first panel 20 may be interchangeable. For example, the first building element 10 may comprise a building element essentially identical the first building panel 20.

The connecting device 1 may comprise a generally rectangular shape, when viewed in the direction Y1, such as substantially quadratic.

The connecting device 1 may comprise a front side and a back side. In assembled position of the connecting device 1 and the first building element 10 the front side may be a proximal side and the back side a distal side. The front side may form a primary plane V1 and may in assembled position be essentially flush with the front surface 15 of the first building element 10 as shown in FIGS. 2C-2D and may extend side-by side with the front surface 15 of the first building element 10.

The back side of the connecting device 1 may form a base plane V0.

The connecting device 1 may comprise a main body portion 5 and the secondary connecting means 4 extending from the main body portion 5 in a direction along the tertiary axis Y1, such as to project from the primary plane V1. The body portion 5 may comprise the first and second primary connecting means 2, 6. When the connecting device 1 and the first building element 10 are configured in assembled position, as shown in FIGS. 2C-2D, the body 5 may be disposed on a distal side of the front surface 15 of the first building element 10. In other words, the body 5 may be arranged between the plane V0 of the back surface 16 and the primary plane V1 of the front surface 15. The connecting device 1 and the first building element 10 are thus arranged side by side in the vertical plane or in the plane of the primary axis Z1 and the secondary axis X1. This configuration is beneficial for the economy of space since the aggregated thickness of the wall 59 may correspond to the aggregated thickness of the first building element 10 and the thickness of the first building panel 20.

The connecting device 1 may be made of any suitable material such as metal, composite, preferably plastic, for example polymer-based material, polyacrylate, polyamide, POM, PP, a thermosetting material or thermoplastic material, vinyl, PVC or the like.

The connecting device may be formed as a single entity, i.e. an element.

FIGS. 6A-6B also shows embodiments of the connecting device 1. The embodiments of the connecting device 1 shown in FIGS. 6A-6B may or may not be inextricably linked to the embodiments of the building panel 20 shown in FIGS. 6A-6B. The second coupling portion 4 may be suitably configured to cooperate with the building panel 20, such as with the locking element 110'.

The connecting device 1 may comprise tertiary connecting means 70. The tertiary connecting means 70 may be configured to facilitate relative positioning between the connecting device 1 and the first panel 20. In particular, the tertiary means 70 may be configured to facilitate relative positioning between the secondary connecting means 4 and the first edge 21 of the first panel 20. The relative positioning may be achieved by displacing and/or biasing a portion of the first edge 21 and a portion of the secondary connecting means 4, such as the first portion 41 and/or the second portion 42, towards each other. Thereby, it is facilitated that the connecting device 1 may be positioned in a desired position where it may not constitute a mechanical obstacle when a second panel 20' is assembled with the first panel 20.

A further advantage of providing tertiary connecting means 70 according to embodiments herein may be that the connecting device 1 may be prevented from dislodging during assembling of for example a second panel 20'.

A still further advantage of providing tertiary connecting means 70 according to embodiments herein may be that the connecting device 1 may be prevented from displacing along the primary axis Z1.

Figure 8J:
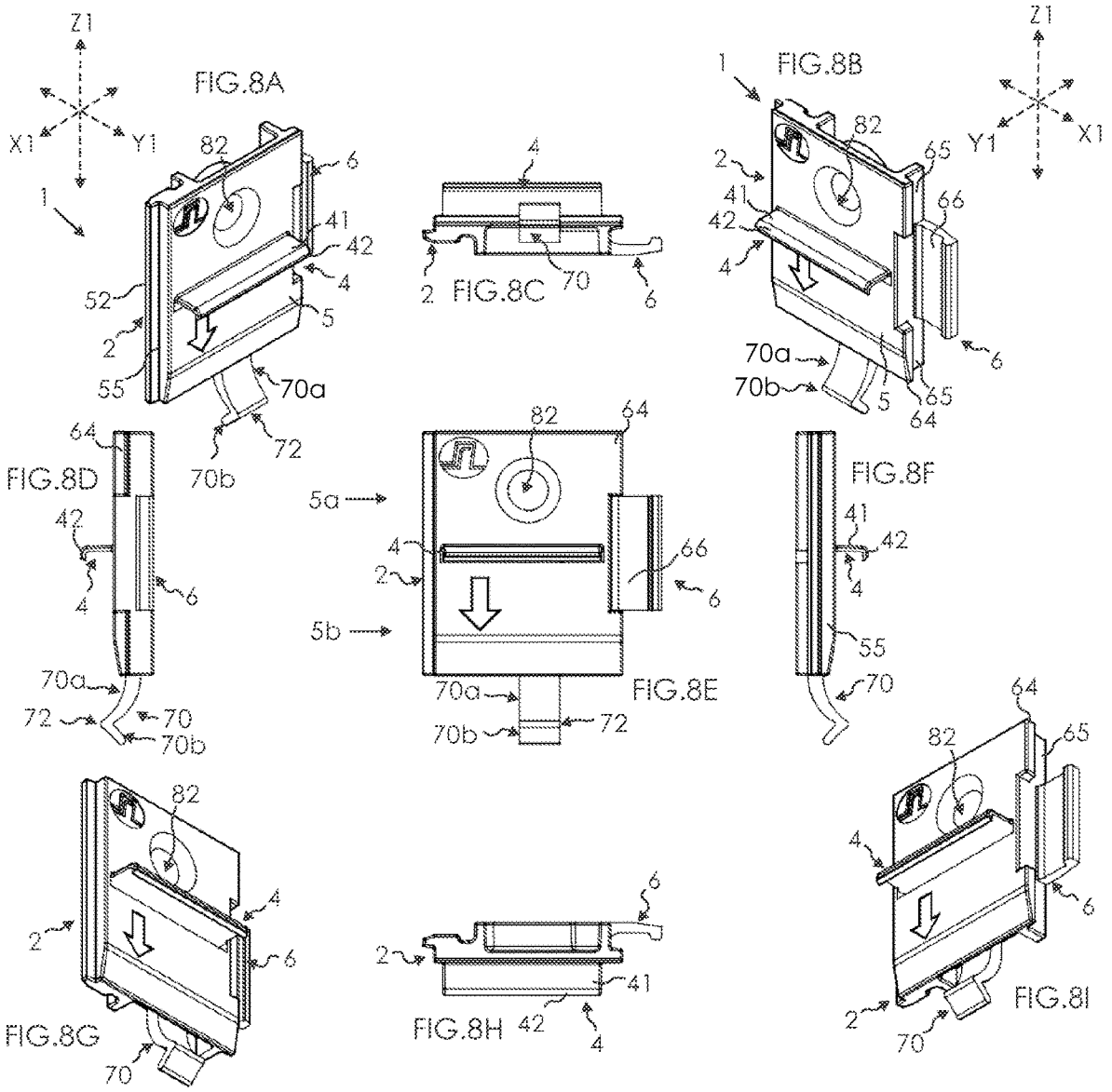
FIG. 8J shows the connecting device of FIGS. 8A-8I in assembled position with a first panel according to an embodiment.
Figure 8J:
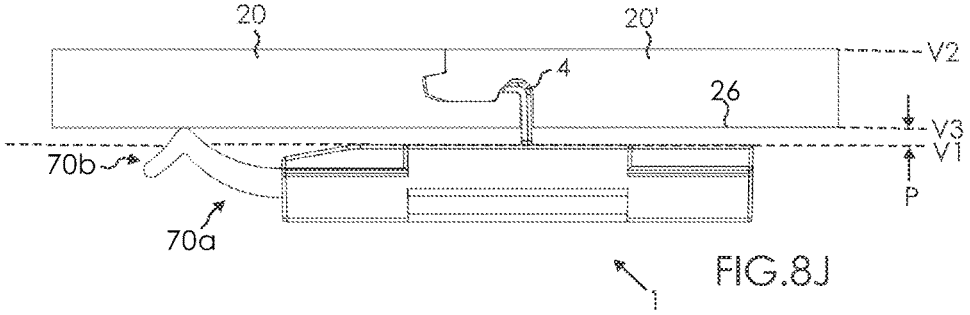
Figures 9A, 9B, 9C, 9D, 9E, 9F, 9G, 9H, 9I:
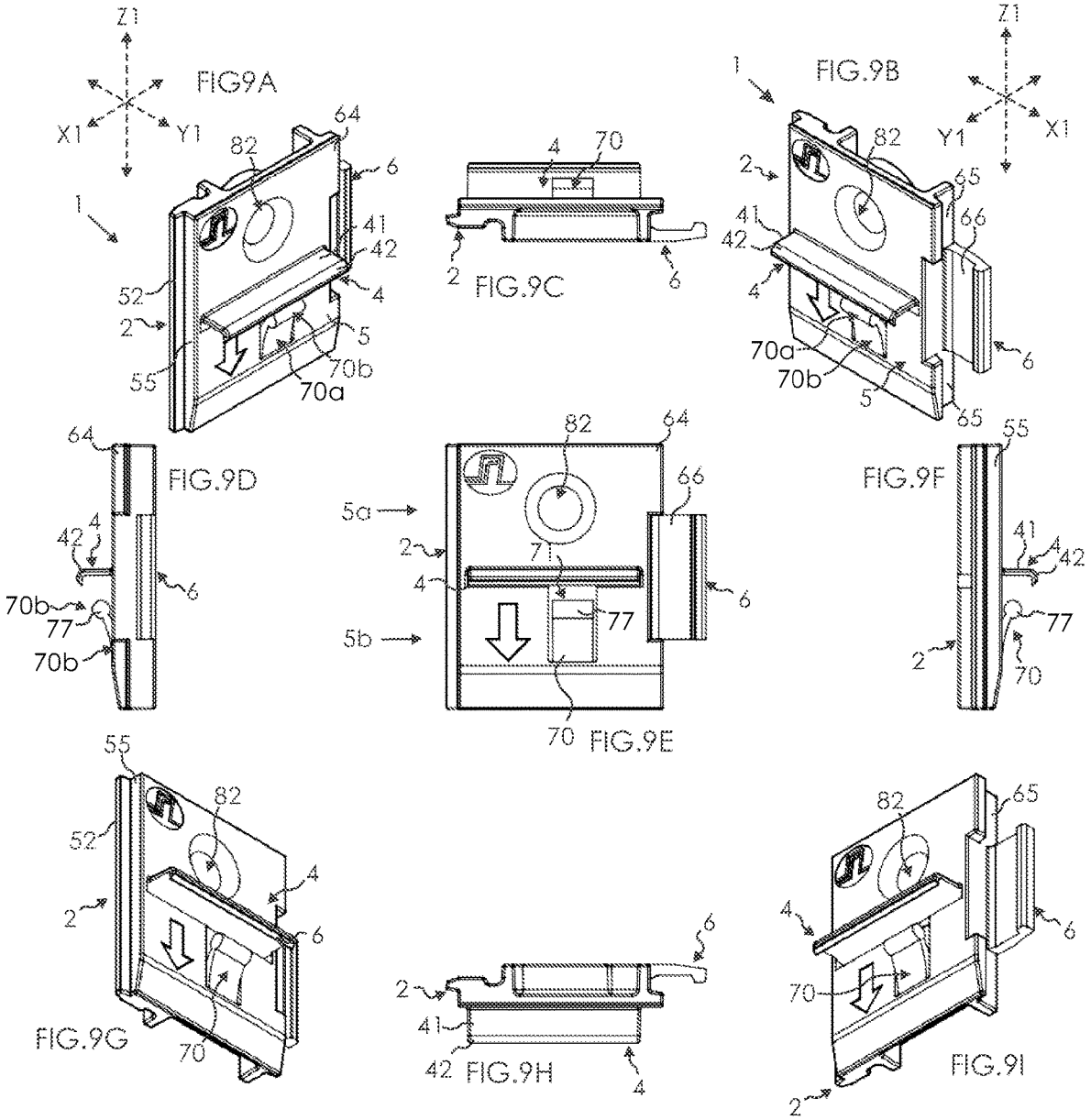
FIGS. 9A-9I show isometric views of a connecting device according to an embodiment.
Figures 10A, 10B, 10C, 10D, 10E, 10F, 10G, 10H, 10I:
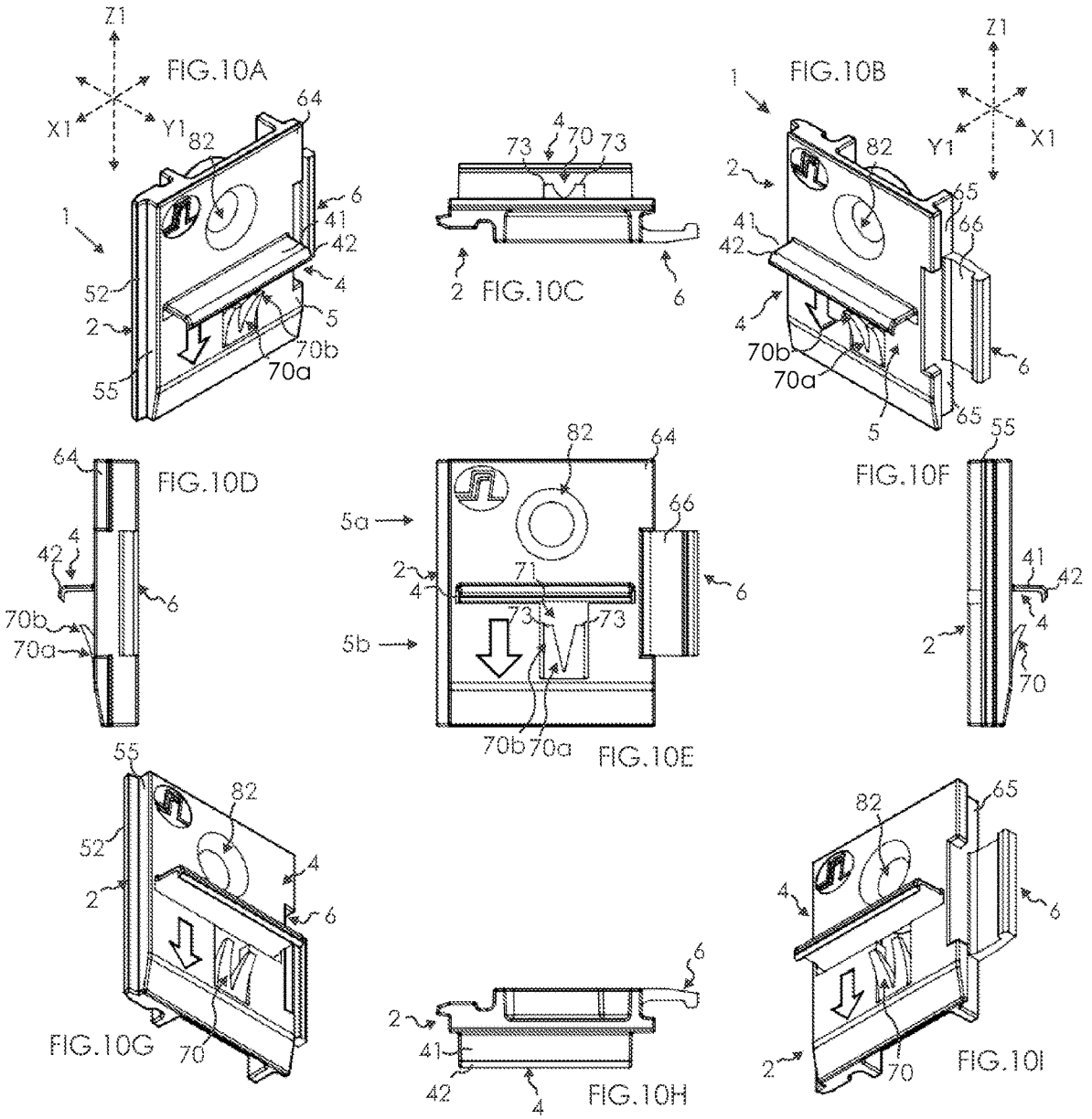
FIGS. 10A-10I show isometric views of a connecting device according to an embodiment.
Figure 11A:
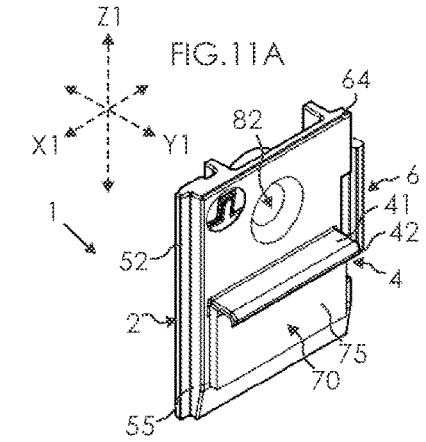
FIGS. 11A-11I show isometric views of a connecting device according to an embodiment.
Figure 11C:
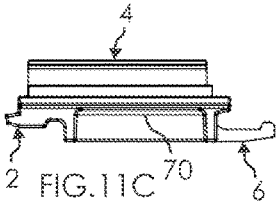
Figure 11B:
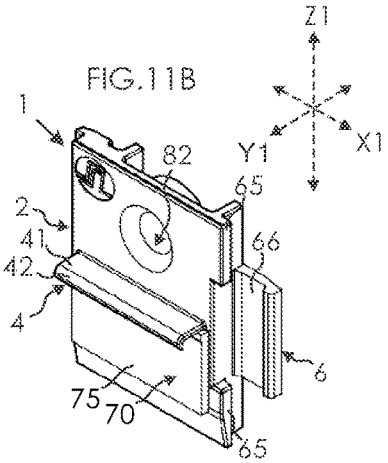
Figure 11D:
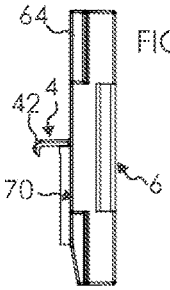
Figure 11E:
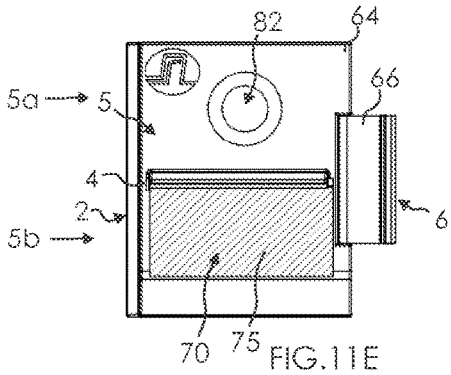
Figure 11F:
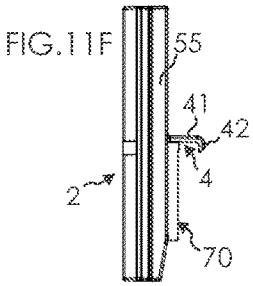
Figure 11G:
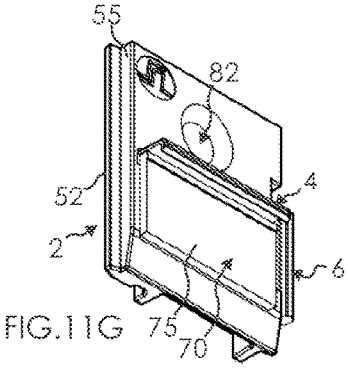
Figure 11H:
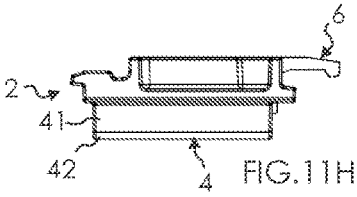
Figure 11I:
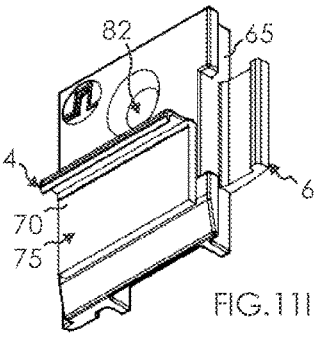
Figure 11J:
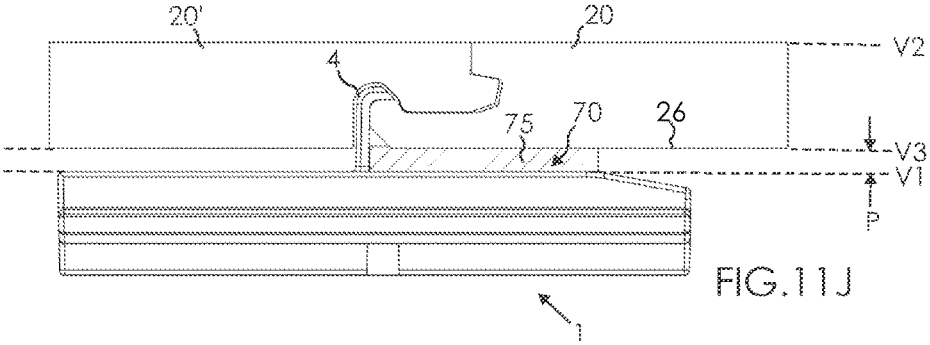
FIG. 11J shows the connecting device of FIGS. 11A-11I in assembled position with a first panel according to an embodiment.
Figures 12A, 12B, 12C, 12D, 12E, 12F, 12G, 12H, 12I, 12J:
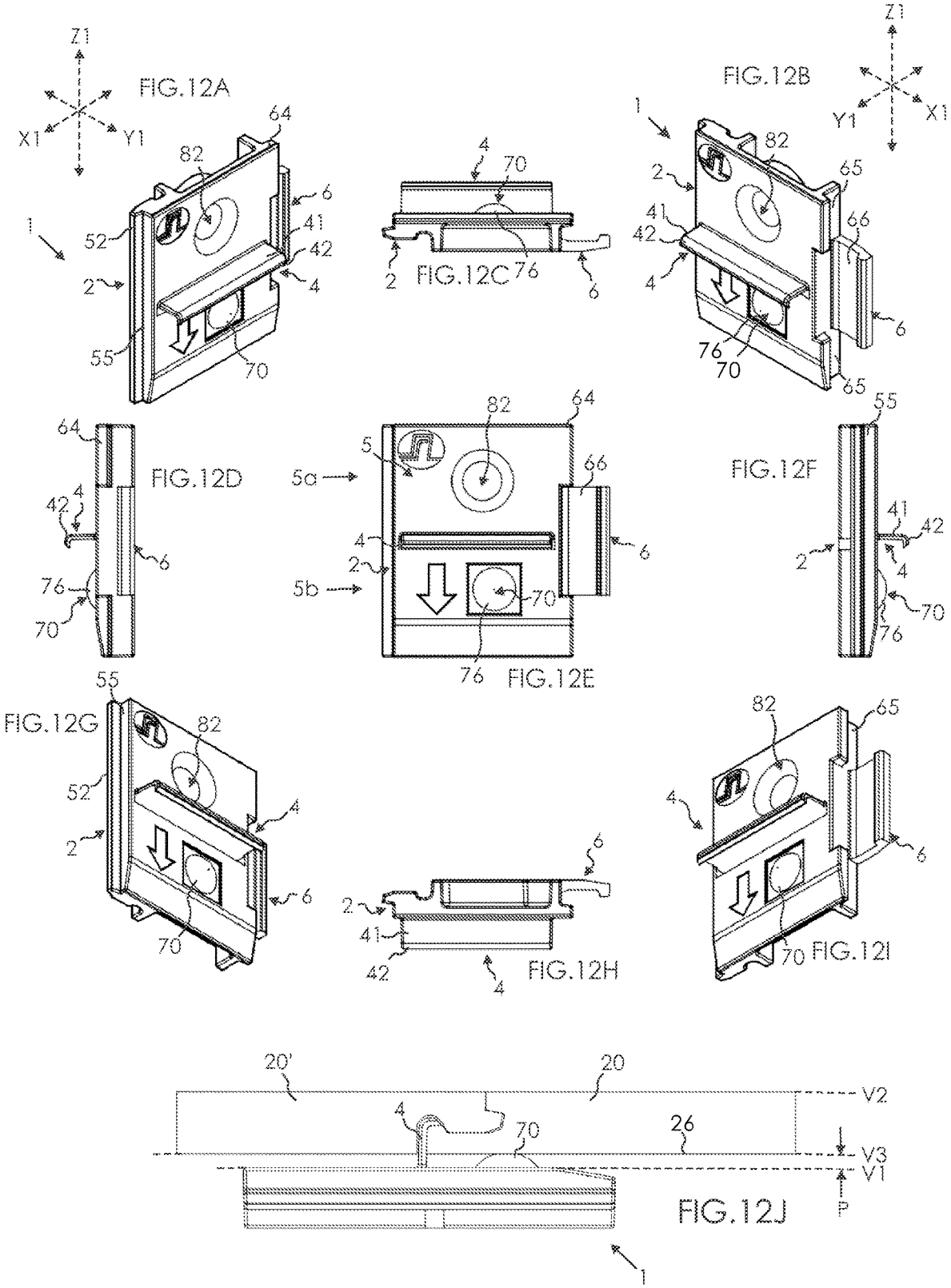
FIGS. 12A-12I show isometric views of a connecting device according to an embodiment.
FIG. 12J shows the connecting device of FIGS. 12A-12I in assembled position with a first panel according to an embodiment.
Figure 13A:
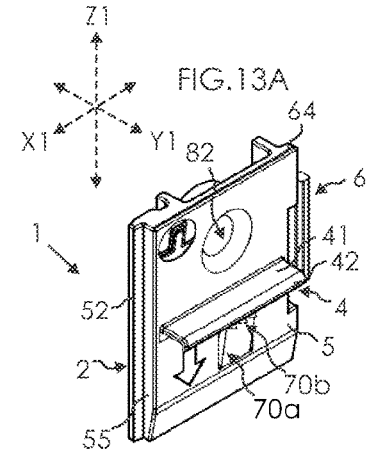
FIGS. 13A-13I show isometric views of a connecting device according to an embodiment.
Figure 13C:
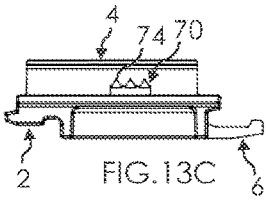
Figure 13B:
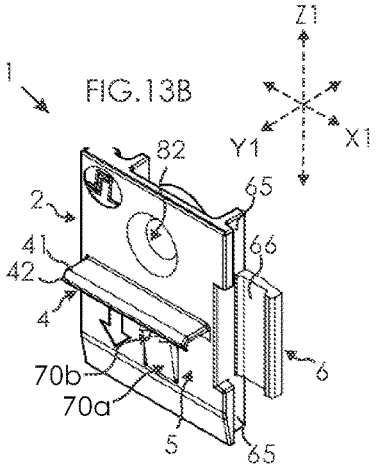
Figure 13D:
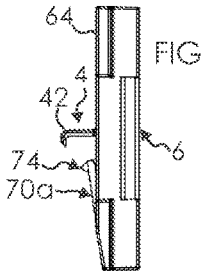
Figure 13E:
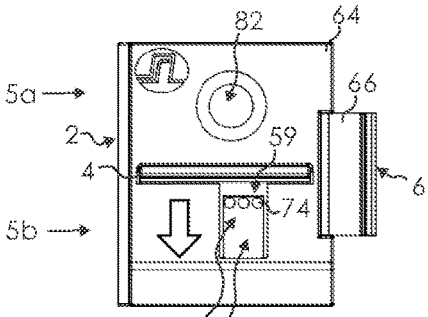
Figure 13F:
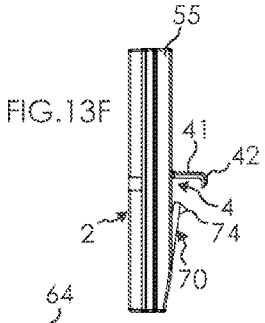
Figure 13G:
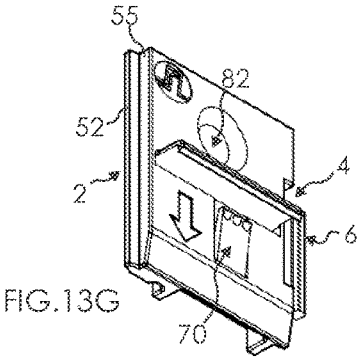
Figure 13H:
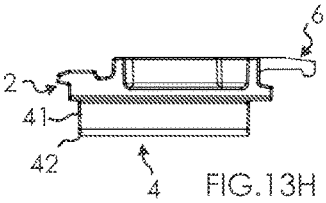
Figure 13I:
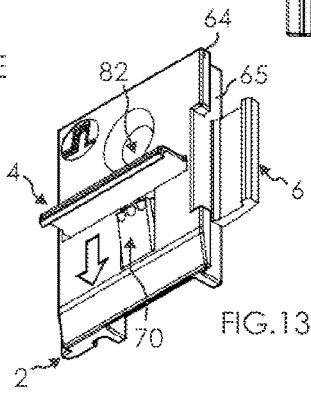

Another advantage of providing tertiary connecting means 70 according to embodiments herein is that the connecting device 1 may thereby be configured to accommodate different thicknesses of the first panel 20. For example, the distance between the surface 114' and the back surface 26 of the first panel 20 may not correspond to the distance between the second portion 42 and the primary plane V1 and/or the body 5 of the connecting device 1. For example, as shown in FIGS. 8J, 11J and 12J there may be play P between the back surface 26 and the primary plane V1 and thus the connecting device 1 and the first panel 20 may in the absence of the tertiary connecting means 70 displace relative each other to obtain an undesired relative position.

The tertiary means 70 may be configured to cooperate with a back surface 26, 26*a* of the first panel 20.

The tertiary means 70 may be provided on a same side of the connecting device 1 as the secondary connecting means 4.

The tertiary means 70 may extend from the connecting device body 5 in a direction towards or away from the secondary connecting means 4.

At least a portion 70*b* of the tertiary means 70 may be displaceable, for example by means of being flexible.

The tertiary means 70 may be provided adjacent the secondary connecting means 4.

The tertiary means 70 may be provided between the first primary connecting means 2 and the second primary connecting means 6.

The tertiary means 70 may be configured to be provided below the secondary connecting means 4, along the primary axis Z, when the building element 10 is configured in assembled position with the first building panel 20 by means of the connecting device 1.

The tertiary means 70 may protrude at least partially in a direction along the secondary axis Y1, preferably at least partially in a direction parallel and in the same direction as the secondary connecting means 4. In particular, the tertiary means may protrude in a direction parallel the first portion 41 of the secondary connecting means 4.

Referring to FIGS. 6A-6B, as has been described herein, the connecting device 1 may be displaced along the tertiary axis Z while being configured in an assembled position with the building element 10.

The secondary connecting means 4 may engage with the first building panel 20, such as a first edge 21 of the first building panel 20, by means of displacing the connecting device 1 along the primary axis Z.

The tertiary means 70 may be configured to engage with a back surface 26 of the first building panel 20 by means of displacing the connecting device along the primary axis Z.

The tertiary means 70 may be configured to engage with a groove 26*a* of provided in the back surface 26 of the first building panel 20, by means of displacing the connecting device along the primary axis Z as shown in FIG. 6A.

The tertiary means 70 may be configured to project from the primary plane V1 in assembled position of the connecting device 1 and the first building panel 20.

The secondary connecting means 4 may protrude in a direction along the tertiary axis Y, from an upper half of the connecting device 1 in respect of the primary axis Z. The tertiary means 70 may protrude in a direction along the tertiary axis Y, approximately at a center position or from a lower half of the connecting device 1 in respect of the primary axis Z1.

Referring to FIG. 6B, the tertiary means 70 may be provided in shape of a flexible tongue having an attached inner portion 70*a* and a free outer end portion 70*b*.

Thus, embodiments of the tertiary means 70 may comprise a first portion 70*a* and a second portion 70*b*. The first portion 70*a* may be a lower portion. The first portion 70*a* may comprise an attached portion. The attached end may be integrally formed with the connecting device. The second portion 70*b* may be an opposite portion. The second portion 70*b* may be an upper portion. The second portion 70*b* may comprise a free end portion. The free end portion may be configured to displace in directions along the tertiary axis Y1.

The second portion 70*b* may be configured to be displaceable along the tertiary axis Y1 at least partially into the connecting device 1 in response to an applied pressure.

The second portion 70*b* may be configured to be displaceable along the tertiary axis Y at least partially into the first building panel 1 in response to an applied pressure.

The second portion 70*b* may be configured to, in assembled position of the connecting device and the first building panel, to be positioned at least partially within the connecting device 1.

The second portion 70*b* may be configured to, in assembled position of the connecting device and the first building panel, to be positioned biased against a back surface of the first building panel 20, as shown in FIG. 6B.

In the embodiment of FIG. 6B, the back surface 26 of the first panel 20 may urge the tertiary means 70, such as a second portion 70*b*, in a distal direction, towards the connecting device 1.

At least the second portion 70*b* of the tertiary means 70 may be configured to be displaced in a first direction, such as a distal direction towards the connecting device 1, by the back surface 26 and subsequently bias towards the back surface 26 in a second opposite direction, such as a proximal direction, such that at least the second portion 42 of the secondary connecting means 4 is biased towards the first building panel 20, as shown in FIG. 6B.

In the embodiment of FIG. 6A, the second portion 70*b* may be configured to, in assembled position of the connecting device and the first building panel, to be positioned at least partially within the first building panel 1, such as in a groove 26*a* of the first building panel 20, as shown in FIG. 6A.

Accordingly, the tertiary means 70, such as the second portion 70*b*, may snap into the groove 26*a* and preferably generate an audible sound while doing so. This may be achieved by causing essentially non-plastic deformation of the tertiary means 70 and/or the secondary means 4, whereby the tertiary means 70 and/or the secondary means 4 only flex. Thereby, a user may be provided with a confirmation that the connecting device 1 is assembled in a locking position with the first building panel 20. In the said assembled position, the connecting device 1 may be locked from displacement along the primary axis Z1 courtesy of the tertiary means 70 engaging with the groove 26*a*.

It should be appreciated that the embodiment of the tertiary means 70 shown in FIG. 6B may be combined with building panels comprising the groove 26*a* in the back surface 26. In such combination, the tertiary means 70, such as the second portion 70*b*, may snap into the groove 26*a* in a corresponding manner as described above. Thereby, a user may be provided with a confirmation that the connecting device 1 is assembled in a locking position with the first building panel 20 and thus in a desired position. In the said assembled position, the connecting device 1 may be locked from displacement along the primary axis Z1 courtesy of the tertiary means 70 engaging with the groove 26*a*.

For all embodiment, the connecting device 1 may further include a fastening hole 82 for a screw or the like, to be able to even more securely fasten the connecting device 1 to a fixed structure, such as a wall, behind the assembled building elements 20, 20'. The fastening hole 82 is an optional feature which is illustrated in FIGS. 7A-7J, 8A-8J, 9A-9I, 10A-10I, 12A-12J.

FIGS. 7A-7J, 8A-8J, 9A-9I, 10A-10I, 12A-12J further show embodiments of the tertiary means 70 comprising a curved profile. The curved profile may extend between the first portion 70*a* and the second portion 70*b*.

The curved profile may extend between the first portion 70*a* and the second portion 70*b*. The curved profile may be flattened out, such as to cause tension in the tertiary means 70, in response to engagement with the back surface 26 of the first building panel 20.

The curved profile may, along its extent along the primary axis Z1, incline from a first inner position, in respect of the tertiary axis Y1, at the first portion 70*a* towards an outer position, in respect of the tertiary axis Y1, at the second portion 70*b*.

The curved profile may comprise a concave shape which recesses inwards towards the connecting device 1 body 5 or a convex shape (see FIGS. 12A-12J) which recesses outwards away from the connecting device 1 body 5.

An embodiment wherein the tertiary means 70, 70 comprises a round or semi-spherical shape 76 is shown in FIGS. 12A-12J.

Generally, at least one portion of said tertiary means 70, 70, preferably the second portion 70*b*, comprises friction-causing means for facilitating friction between said at least one portion and an adjacent surface, such as the back surface 26 of the first panel 20. For example, said friction-causing means comprises sharp and/or pointy elements 74 as illustrated in FIGS. 13A-13I. The sharp and/or pointy elements 74 may have an extension of between 0.1 and 1.0 mm., more preferably between 0.1 and 0.5 mm., even more preferably about 0.2 mm.

In some embodiments, such as shown in FIGS. 7A-7J and 8A-8J, at least one portion of said tertiary means 70, preferably the second portion 70*b*, comprises a continuous edge 72 extending in a direction along the secondary axis X1.

In the embodiment of FIGS. 8A-8J, the tertiary means 70 extends from a lower portion 5*b* of the connecting device 1. The first portion 70*a* may be integrally formed with a lowermost portion, such as an edge portion, of the lower portion 5*b* and extend in a direction away from body 5 to the second portion 70*b*. The embodiment of the tertiary means 70 may comprise a curved shape as explained herein.

An embodiment wherein the second portion 70*b* of the tertiary means 70, 70 comprises an essentially cylindrical shape 77 is shown in FIGS. 9A-9I. The cylindrical shape 77 may extend with its longitudinal axis parallel the secondary axis X1. The essentially cylindrical shape 77 may preferably be displaceable and adapted to cooperate with the back surface 26*a* of the first panel 20. The embodiment of the tertiary means 70 may comprise a curved shape as explained herein.

In some embodiments, such as shown in FIGS. 10A-10I, at least one portion of said tertiary means 70, 70, preferably the second portion 70*b*, comprises a discontinuous edge 73 extending in a direction along the secondary axis X1. In the exemplary embodiment of FIGS. 10A-10I, the tertiary means 7 comprises two second portions 70*b*. From the first portion 70*a* the tertiary means 70 splits into the two second portions 70*b* which are preferably displaceable end portions. The embodiment of the tertiary means 70 may comprise a curved shape as explained herein.

The tertiary means 70 may in any embodiment comprise means for facilitating friction. Said means may comprise a pattern and/or a material configured to facilitate friction. Said material may be a material different from the material of the connecting device body 5. Thus, the tertiary means 70 may in any embodiment comprise a different material. The means for facilitating friction may comprise a polymer-based material such as rubber, a silicone or like.

As has been described herein, the tertiary connecting means 70 may according to embodiments facilitate a desired relative positioning of the connecting device 1 and the first panel 20 and thereby be configured to accommodate different thicknesses of the first panel 20. As shown in FIGS. 8J, 11J and 12J, the thickness of at least a portion of the first panel 20 may result in a play P between the primary plane V1 and a tertiary plane V3 of the back surface 26 of the first panel 20. Accordingly, any embodiment of the tertiary means 70 may be configured to bridge a play P between the primary plane V1 and the back surface 26 of the first panel 26. The play P may be from about 0.1 to 5 mm. Preferably the tertiary means 70 is in contact with the back surface 26, 26*a* of the first panel 20. This configuration may bring about the advantage the connecting device 1 is arranged in a desired position relative the first panel 20 in assembled position thereof.

In FIGS. 11A-11J there is shown an embodiment of the tertiary means 70 comprising friction causing means 75. The tertiary means 70 may in this embodiment comprise the same material as the connecting device body 5 or a different material, such as a material facilitating friction. Preferably said material configured to cause a frictional force being relatively greater than said material of the connecting device 1 in response to a provided pressure or force.

The material may comprise at least one of a cushioning material, a more compressible and/or softer then the material of the connecting device body 5.

The tertiary means 70 may in this embodiment comprise a pattern configured to facilitate friction, as has been explained herein. An example of such embodiment is shown for instance in FIG. 11E.

An embodiment of the tertiary means 70 comprising a curved shape in form of a semi-spherical portion 76 is shown in FIGS. 12A-12J. The semi-spherical portion 76 may in some embodiments comprise a material configured to facilitate friction, as explained herein.

A further example of the means configured to facilitate friction is shown in FIGS. 13A-13I, wherein the means comprises pointy members 74. The pointy members 74 may for example be provided at the second portion 70*b* and point in a direction toward the back surface 26*a* in assembled position of the connecting device 1 and the first panel 20.

Although the present inventive concept has been described and illustrated in detail, it is clearly understood that the same is by way of illustration and example only and is not to be taken by way of limitation, the spirit and scope of the present inventive concept being limited only by the terms of the appended claims.

Items

ITEM 1. A connecting device 1 for connecting a first building element 10 and first building panel 20 and preferably a second building panel 20', wherein the connecting device 1 is configured for assembling the first building panel 20 and the second building panel 20' to the first building element 10, wherein the connecting device 1 comprises primary connecting means 2, 6 extending in a direction along a primary axis Z1 and configured to cooperate with a first mechanical locking system 80 of a first edge 11 of the first building element 10 extending along the primary axis Z1, to obtain an assembled position therewith, preferably by means of a folding displacement of the connecting device 1 about the primary axis Z1, to thereby lock the connecting device 1 from displacement along a secondary axis X1 and a perpendicular tertiary axis Y1 each being orthogonal the primary axis Z1; and wherein the connecting device 1 comprises secondary connecting means 4 extending in a direction along the tertiary axis Y1 and configured to cooperate with a first edge 21 of the first building panel 20.

ITEM 2. The connecting device 1 according to item 1, wherein the secondary connecting means 4 is configured to cooperate with a second mechanical locking system 80' of the first edge 21 of the first building panel 20 and a second opposite edge 22' of the second building panel 20', wherein said first and second edge 21, 22' are configured to cooperate for horizontal and vertical locking from parting away from each other by means of the second mechanical locking system 80'.

ITEM 3. The connecting device 1 according to any one of the preceding items 1 or 2, wherein the connecting device 1 further comprises tertiary means 70 configured to cooperate with the first panel 20.

ITEM 4. The connecting device 1 according to any one of the preceding items 2 to 3, wherein the second locking system 80' is configured for locking the first and second panels 20, 20' in a direction transverse of the plane of the front surface 25, 25' by means of a folding displacement of the second panel 20' about its second edge 22'.

ITEM 5. The connecting device 1 according to any one of the preceding items 2 to 4, wherein the second locking system 80' is configured for locking the first and second panels 20, 20' in a direction along the primary axis Z1, preferably by means of a folding displacement, such as a folding displacement of the second panel 20' about its second edge 22'.

ITEM 6. The connecting device 1 according to any one of the preceding items 2 to 5, wherein the second locking system 80' of said second edge 22' comprises a locking groove 125' which opens in a direction along the tertiary axis Y1 in assembled position of the first and second panels 20, 20', said locking groove configured to receive a locking element 110' of the second locking system 80' of the first edge 21 of the first panel 20, said locking element 110' extending in a direction along the tertiary axis Y1.

ITEM 7. The connecting device 1 according to item 6, wherein said locking element 110' is received in said locking groove 125' by means of said folding displacement of the second panel 20' about its second edge 22' to thereby lock the second panel 20' and the first panel 20 from parting away in a direction of the plane of the front surface 25 and transverse the second edge 22 of the first panel 20.

ITEM 8. The connecting device 1 according to items 3-7, wherein said tertiary means 70 comprises at least one protruding member 70, 70*a*, 70*b*, 74, 75, 76, 77.

ITEM 9. The connecting device 1 according to item 8, wherein said at least one protruding member 70, 70*a*, 70*b*, 74, 75, 76, 77 is configured to, in assembled position of the connecting device 1 and the first building element 10, protrude from a primary plane V1 of a proximal surface of the connecting device 1.

ITEM 10. The connecting device 1 according to any one of the preceding items 3 to 9, wherein said tertiary means 70 are configured to cooperate with a back surface 26 of the first panel 20.

ITEM 11. The connecting device 1 according to any one of the preceding items 3 to 10, wherein said tertiary means 70 are configured for relative positioning of at least a portion of the connecting device 1, such as the secondary connecting means 4, and at least a portion of the first panel 20, such as the first edge 21.

ITEM 12. The connecting device 1 according to any one of the preceding items 3 to 11, wherein said tertiary means 70 are configured to, in assembled position of the connecting device 1 with the first panel 20, bias against the back surface 26 of the first building panel 20.

ITEM 13. The connecting device 1 according to any one of the preceding items 3 to 12, wherein said tertiary means 70 are configured to, in assembled position of the connecting device 1 with the first panel 20, bias the secondary connecting means 4 in a direction along the tertiary axis Y1 towards the first building panel 20, such as in a distal direction.

ITEM 14. The connecting device 1 according to any one of the preceding items 3 to 13, wherein said tertiary means 70 are configured to, during assembling of the connecting device 1 with the first building panel 20, displace at least a portion of the first building panel 20 and/or displace the connecting device 1 in a direction along the tertiary axis Y1.

ITEM 15. The connecting device 1 according to any one of the preceding items 3 to 14, wherein said tertiary means 70 are configured to, in assembled position of the connecting device 1 with the first panel 20, cooperate with a groove 26*a* provided in the back surface 26*a* of the first panel 20 to thereby lock or prevent the secondary connecting means 4 and the first edge 21 of the first panel 20 from parting away from each other in a direction along the primary axis Z1.

ITEM 16. The connecting device 1 according to any one of the preceding items 3 to 15, wherein said tertiary means 70 comprises at least one portion 70*b* that is displaceable relative the secondary connecting means 4, such as in a direction along the tertiary axis Y1.

ITEM 17. The connecting device 1 according to any one of the preceding items 3 to 16, wherein said tertiary means 70 comprises an attached portion 70*a* and at least one free portion 70*b*, preferably said at least one free portion 70*b* is an end portion.

ITEM 18. The connecting device 1 according to any one of the preceding items 3 to 17, wherein said tertiary means 70, 70 comprises at least one portion extending along the primary axis Z1 in a direction towards or away from secondary connecting means 4, and from an attached portion 70*a* to a free portion 70*b*.

ITEM 19. The connecting device 1 according to any one of the preceding items 3 to 18, wherein at least one portion of said tertiary means 70, preferably the second portion 70*b*, comprises a continuous edge 72 or a discontinuous edge 73 in a direction along the secondary axis X1.

ITEM 20. The connecting device 1 according to any one of the preceding items 3 to 19, wherein at least one portion of said tertiary means 70, preferably the second portion 70*b*, comprises means configured to facilitate friction, such as friction between said at least one portion and an adjacent surface, such as the back surface 26 of the first panel 20.

ITEM 21. The connecting device 1 according to item 20, wherein said means configured to facilitate friction comprises sharp and/or pointy elements 74.

ITEM 22. The connecting device 1 according to any one of the preceding items 3 to 21, wherein said tertiary means 70 comprises a material being different from a material of a body 5 of the connecting device 1, preferably said material configured to facilitate a frictional force being relatively greater than said material of the connecting device 1 body 5 in response to a provided pressure or force.

ITEM 23. The connecting device 1 according to any one of the preceding items 3 to 22, wherein tertiary means 70 comprises a round or semi-spherical shape 76.

ITEM 24. The connecting device 1 according to any one of the preceding items 3 to 23, wherein said tertiary means 70 comprises an essentially cylindrical shape 77, preferably having a longitudinal axis parallel secondary axis X1.

ITEM 25. The connecting device 1 according to any one of the preceding items 3 to 24, wherein said tertiary means 70 comprises a curved profile between the first portion 70*a* and the second portion 70*b*, wherein the curved profile comprises a concave shape which recesses inwards towards a body 5 of the connecting device 1 or a convex shape which recesses outwards away from the body 5 of the connecting device 1.

ITEM 26. The connecting device 1 according to any one of the preceding items 3 to 25, wherein the connecting device 1 body 5 comprises a slot 71, wherein said tertiary means 70 is provided at least partially in said slot 71.

ITEM 27. The connecting device 1 according to item 26, wherein the slot 71 is configured to at least partially receive said tertiary means 70, such as a displaceable second portion 70*b* thereof.

ITEM 28. The connecting device 1 according to any one of the preceding items 3 to 27, wherein at least a portion 70, 70*a*, 70*b*, 72, 73, 74, 75, 76, 77 of the tertiary means 70 is integrally formed with the connecting device 1.

ITEM 29. The connecting device 1 according to any one of the preceding items 3 to 28, wherein the tertiary means 70 are configured to bridge a play P, such as over said play P, between a primary plane V1 of a proximal surface of the connecting device body 5 and a back surface 26 of the first panel 20.

ITEM 30. A set comprising the connecting device 1, a building element 10, 10' and a building panel 20, 20' according to any one of the preceding items 1 to 29.

ITEM 31. The set according to the preceding item 29, wherein the first locking system 80 and the second locking system 80' are essentially identical or identical locking systems.

The invention claimed is:

1. A connecting device for connecting a first building element and first building panel, the connecting device comprising at least one primary connecting means extending in a direction along a primary axis, and the connecting device being configured to cooperate with a first mechanical locking system of a first edge of the first building element, to obtain an assembled position therewith, such that a folding displacement of the connecting device relative to the first building element about the primary axis causes the connecting device to become locked from displacement relative to the first building element along a secondary axis and a tertiary axis, the primary axis extending along the first edge of the first building element, the secondary and tertiary being perpendicular to each other, and the secondary and tertiary axes each being orthogonal to the primary axis;

wherein the connecting device comprises secondary connecting means extending in a direction along the tertiary axis and configured to cooperate with a second mechanical locking system of respective first and opposite second edges of the first building panel and a second building panel; and wherein the connecting device further comprises tertiary means configured to cooperate with the first panel.

2. The connecting device according to claim 1, wherein said tertiary means comprises at least one protruding member.

3. The connecting device according to claim 2, wherein said at least one protruding member is configured to, in assembled position of the connecting device and the first building element, protrude from a primary plane of a proximal surface of the connecting device.

4. The connecting device according to claim 1, wherein said tertiary means are configured to cooperate with a back surface of the first panel.

5. The connecting device according to claim 1, wherein said tertiary means are configured for relative positioning of at least a portion of the connecting device and at least a portion of the first panel.

6. The connecting device according to claim 1, wherein said tertiary means are configured to, in assembled position of the connecting device with the first panel, bias against the back surface of the first building panel.

7. The connecting device according to claim 1, wherein said tertiary means are configured to, in assembled position of the connecting device with the first panel, bias the secondary connecting means in a direction along the tertiary axis towards the first building panel.

8. The connecting device according to claim 1, wherein the tertiary means are configured to bridge a play between a primary plane of a proximal surface of the connecting device body and a back surface of the first panel.

9. The connecting device according to claim 1, wherein said tertiary means are configured to, in assembled position of the connecting device with the first panel, cooperate with a groove provided in the back surface of the first panel to thereby lock or prevent the secondary connecting means and the first edge of the first panel from parting away from each other in a direction along the primary axis.

10. The connecting device according to claim 1, wherein said tertiary means comprises at least one portion that is displaceable relative the secondary connecting means.

11. The connecting device according to claim 1, wherein said tertiary means comprises an attached portion and at least one free portion.

12. The connecting device according to claim 1, wherein said tertiary means comprises at least one portion extending along the primary axis in a direction towards or away from the secondary connecting means, and from an attached portion to a free portion.

13. The connecting device according to claim 1, wherein at least one portion of said tertiary means comprises means configured to facilitate friction.

14. A set comprising the connecting device, a building element and a building panel according to claim 1.

15. The set according to the preceding claim 14, wherein the first locking system and the second locking system are essentially identical or identical locking systems.

16. The connecting device according to claim 1, wherein the primary connecting means includes a locking strip extending along the secondary axis, and a locking element extending along the tertiary axis and provided on the locking strip, wherein the folding displacement of the connecting device relative to the first building element about the primary axis causes the locking element to enter a locking groove of the first edge of the first building element, which entering causes the connecting device to become locked from displacement relative to the first building element along the secondary axis and the perpendicular tertiary.

* * * * *